United States Patent [19]

Katoh et al.

[11] Patent Number: 5,064,752

[45] Date of Patent: Nov. 12, 1991

[54] SILVER HALIDE PHOTOGRAPHIC MATERIALS

[75] Inventors: Kazunobu Katoh; Kozo Sato; Keisuke Shiba, all of Kanagawa, Japan

[73] Assignee: Fuji Photo Film Co., Ltd., Kanagawa, Japan

[21] Appl. No.: 542,685

[22] Filed: Jun. 25, 1990

Related U.S. Application Data

[63] Continuation of Ser. No. 194,663, May 16, 1988, abandoned.

[30] Foreign Application Priority Data

May 15, 1987 [JP] Japan ..... 62-118519

[51] Int. Cl.[5] ..... G03C 5/54; G03C 7/36; G03C 1/38; G03C 1/42

[52] U.S. Cl. ..... 430/546; 430/222; 430/223; 430/559; 430/564; 430/566; 430/598; 430/631

[58] Field of Search ..... 430/222, 232, 546, 631, 430/512, 517, 566, 564, 598, 559

[56] References Cited

U.S. PATENT DOCUMENTS

| | | | |
|---|---|---|---|
| 3,335,011 | 8/1967 | White | 430/546 |
| 3,788,857 | 1/1974 | Van Poucke et al. | 430/546 |
| 4,368,259 | 1/1983 | Nittel et al. | 430/222 |
| 4,371,604 | 2/1983 | Van de Sande et al. | 430/223 |
| 4,450,223 | 5/1984 | Van Poucke et al. | 430/223 |
| 4,477,554 | 10/1984 | Van de Sande et al. | 430/223 |
| 4,594,316 | 6/1986 | Morimoto et al. | 430/223 |
| 4,783,396 | 11/1988 | Nakamura et al. | 430/203 |

*Primary Examiner*—Richard L. Schilling
*Attorney, Agent, or Firm*—Sughrue, Mion, Zinn, Macpeak & Seas

[57] ABSTRACT

A silver halide photographic material comprising a support having provided thereon at least two hydrophilic colloid layers, wherein at least one of the hydrophilic layers comprises water or a hydrophilic colloid and a compound represented by formula (I) dispersed therein using water or a water-soluble organic solvent:

$$\text{PWR-(Time)}_t\text{-PUG} \qquad \text{(I)}$$

wherein PWR represents a group capable of releasing $(\text{Time})_t$-PUG upon reduction;

Time represents a group capable of releasing the PUG residual group by the successive reaction, after being released as $(\text{Time})_t$-PUG;

t represents 0 or 1;

PUG represents a photographically useful group; and at least one water-soluble group exists in one molecule of the compound.

15 Claims, No Drawings

SILVER HALIDE PHOTOGRAPHIC MATERIALS

This is a continuation of application No. 07/194,663 filed May 16, 1988, now abandoned.

FIELD OF THE INVENTION

The present invention relates to a silver halide photographic material in which a functional compound capable of being cleaved in the presence of a reducing agent to display various photographically advantageous effects, has been incorporated uniformly, stably and effectively in particular layer(s) thereof. This invention especially relates to a black-and-white or color photographic material which has improved image sharpness, tone reproductivity and color reproductivity and which has also been improved to be handled with ease.

BACKGROUND OF THE INVENTION

A silver halide photographic material comprises various hydrophilic colloid layers such as subbing layers, silver halide light-sensitive layers, interlayers, filter layers, protective layers, anti-halation layers, etc., coated on a support. The number of the layers to be coated is increasing more and more, in order to improve the quality of the material and to enhance the ease of handling thereof.

Photographic materials contain various photographic elements, for example so-called additives such as sensitizer dyes development accelerators, anti-foggants, stabilizers, etc., as well as dyes, surfactants and antioxidants, in addition to light-sensitive silver halide grains. Especially in addition to light-sensitive silver halide grains. Especially in the case of color photographic materials, the material further contains color couplers, color image stabilizers, color mixing preventing agents, ultraviolet absorbents, polymer latexes, etc. These additives are described, for example, in *Research Disclosure*, (RD No. 17643) and (RD No. 18716), etc. These additive elements, especially those which may directly participate in the photographic properties are naturally desired to be incorporated and fixed independently in the respective layers, which, however, is not always sufficient. For instance, sensitizing dyes and anti-foggants are often adsorbed to silver halide grains and fixed thereon. However, the adsorption strength is not sufficient, which is one reason for the deterioration of the stability of photographic materials with the lapse of time. Regarding color couplers, color image stabilizers, color mixing preventing agents, etc., after the molecules have been made hydrophobic and additionally have been bonded with a ballast group, these compounds are finely dispersed in an oil or a polymer and the resulting fine grain dispersion is fixed on silver halide grains. Accordingly, the photographic layer as coated on a support becomes bulky and thick, which is one reason for the deterioration of the image sharpness of the resulting photographic materials.

On the other hand, a Fisher type color coupler having a water-soluble group-containing ballast group is formed into an alkali solution and this is dispersed and fixed on silver halide grains. However, solids are formed during the manufacture of the solution causing coating unevenness and formation of spots on the surface of the resulting materials. Accordingly, such Fisher type color couplers tends to be unusable at present.

Regarding dyes, good methods are unavailable which are capable of sufficiently fixing the dyes on silver halide grains. Accordingly, most of the dyes are uniformly incorporated in the respective layers. A methods of providing a mordant layer may be considered for the fixation of dyes, which, however, shows disadvantageous effects, in that the mordant layer is hardly formed as a particular layer among many other layers. Accordingly, a colloidal silver is used for yellow filter layers or anti-halation layers at present.

The elements fixed in layers are required to be removed therefrom after process for formation of images, except elements which may be directly related to the images themselves and the storage stability thereof. However, most of them are insufficient. In this connection, the improved removal of dyes and sensitizing dyes is required, since their presence causes unfavorable color retention.

SUMMARY OF THE INVENTION

The first object of the present invention is to provide a silver halide photographic material into which the above-noted functional compound has been selectively incorporated into particular hydrophilic colloid layer(s) of the photographic material, by introducing a new mechanism into the said compound.

The second object of the present invention is to provide a silver halide photographic material whose photographic property has been improved by incorporation of a functional compound capable of being reduced in the presence of a reducing substance to effectively display a photographically advantageous effect, in which the functional compound is uniformly cleaved in the image-forming processing step in accordance with the object of the compound as one embodiment, or alternatively, the functional compound is reversely imagewise cleaved, indirectly, depending upon the development of the silver halide of the material, so as to attain the advantageous effects of the compound.

Other objects of the present invention will be apparent from the description set forth in the specification hereafter.

The noted objects of the present invention can be attained by a silver halide photographic material comprising a support having provided thereon at least two hydrophilic colloid layers, wherein at least one of the hydrophilic colloid layers comprises water or a hydrophilic colloid and a compound represented by formula (I) dispersed therein using water or a water-soluble organic solvent:

$$\text{PWR-(Time)}_t\text{-PUG} \qquad \text{(I)}$$

wherein PWR represents a group capable of releasing $(\text{Time})_t$-PUG upon reduction;

Time represents a group capable of releasing the PUG residual group by the successive reaction (e.g., an intramolecular nucleophilic substitution reaction and an intramolecular electron transfer reaction), after being released as $(\text{Time})_t$-PUG;

t represents 0 or 1;

PUG represents a photographically useful group; and at lease one water-soluble group exists in one molecule of the compound.

DETAILED DESCRIPTION OF THE INVENTION

A characteristic aspect of the present invention resides in the incorporation of the compound of formula (I) into the hydrophilic colloid layer(s) of a photographic silver halide material. The compound of formula (I) is a so-called functional compound as referred to in the present invention. The compound is cleaved in the presence of a reducing substance to display a photographically useful function, or alternatively, the functional compound itself has a photographically useful function, and may be cleaved and decomposed in order to be released from a special hydrophilic colloid layer. The reducing substance can be incorporated into the photographic material in such a form that it may not act as a reducing substance under the normal hydrophilic colloid layer state (for example, an acid or neutral condition), but may become active in the presence of an image-forming processing solution (for example, an alkaline developer). Alternatively, the reducing substance can be incorporated into an image-forming processing solution.

For instance, the case where PUG is a dye residue will be explained hereunder as one example. As one embodiment of the use of the functional compound in such a case, the functional dye of the invention is incorporated into a protective layer, so that the sensitivity in a particular spectral absorption wavelength range is lowered. If the functional dye is uniformly cleaved in the presence of a reducing substance, the dye residue may be released out from the photographic material so that the dye does not cause color retention in the material.

A second characteristic aspect of the present invention resides in the method of incorporating the functional compound of the invention into particular hydrophilic colloid layers in the photographic material. The functional compound of the present invention contains at least one water-soluble group, e.g., a sulfonic acid group or a salt thereof, a carboxyl group or a salt thereof, a sulfuric acid group or a salt thereof, a phosphoric acid group or a salt thereof, as well as a hydroxyl group, a sulfamide group, a formamide group, etc. In addition, it is preferred that the compound has an aliphatic group having from 4 to 18 carbon atoms (hereinafter referred to as "$C_4$ to $C_{18}$ aliphatic group"), for example, a substituted or unsubstituted linear or branched alkyl or alkylene group, etc., and more preferably an aliphatic group substituted sulfamoyl or carbamoyl group, as a ballast group.

The functional compound of the present invention is easily dissolved in water to form micelles and is apt to display a Krafft phenomenon. In particular, compounds which have a Krafft temperature of about 110° C. or lower, preferably 100° C. or lower are preferred as the functional compounds. Regarding Krafft phenomenon and Krafft temperature, J. L. Moilliet, et al., *Surface Activity*, 2nd Ed., pages 26 to 27 (1961), may be referred to. The Krafft temperature can be actually obtained by the method described in the following example.

If the compound has a Krafft temperature higher than about 110° C., unfavorable solids would often be formed in the compound-containing dispersion. On the other hand, if the compound has a Krafft temperature lower than 20° C., the dispersion would often diffuse into the adjacent layers. Accordingly, the Krafft temperature of the functional compound of the present invention is preferably 20° C. or higher.

The functional compound of the present invention can more easily form micelles than Fisher-type couplers, and in particular, these compounds can be sufficiently resistant against interlayer diffusion, even though they have a low molecular weight and do not contain the above-noted ballast group. The diffusion-resistance (i.e., non-diffusibility) of the compound can be evaluated by the diffusion constant in a gelatin gel. In the practice of the present invention, when the compounds have a diffusion constant lower than about $1\times10^{-6}$ cm²/sec, they can be said to be practically non-diffusible. For measurement of the diffusion constant, B. Vlcek and S. Vlckova, *Zhur. Nauch. i Priklad. Foto. i Kinema.*, 5, 187 to 194 (1960), can be referred to.

The method for measurement of the diffusion constant of the functional compound for use in the present invention is as follows.

(1) $2.5\times10^{-5}$ mol of the compound of the present invention is weighed and dissolved in 3.0 ml of DMF (dimethylformamide), and then the resulting solution is added to 20 g of an aqueous 10 wt % lime-processed gelatin solution. Water is added thereto to make 25 ml. This is Solution A. (The concentration of the compound of the present invention is $1.0\times10^{-3}$ mol/liter.)

(2) Next, a cylindrical glass cell (A) having an inner diameter of 1.5 cm and a length of 5.0 cm is stood on a glass plate on a cooling bed at from 0° to 5° C., and the above-mentioned solution containing the compound of the present invention (Solution A) is introduced into the cell from the top thereof and then cooled to 0° to 5° C. and gelled.

(3) About 10 minutes after the gelation, the glass cell (A) is released from the glass plate and is again stood on the glass plate as overturned, so that the surface which has been kept in contact with the glass plate is on top, and an empty glass cell (B) with the same dimensions as glass cell (A) is superposed thereon.

(4) A blank gelatin solution (Solution B) which has the same composition as Solution A, but does not contain the compound of the present invention, is prepared and, after the temperature has been adjusted to about 28° C., Solution B is gently introduced into the glass cell from the top thereof. After being cooled and gelled in a refrigerator at a temperature of from 0° to 5° C., the thus gelled sample is kept in a measurement chamber at room temperature.

(5) After about 24 hours, the two glass cells are released from each other, and the amount of the compound as diffused into the glass cell (B) is measured by spectrophotometry.

(6) The diffusion constant of the functional compound is calculated from the following formula:

$$D = \frac{m^2\pi}{q^2Co^2t}$$

where m represents the amount of the compound diffused (mol);

Co represents the initial density of the compound (mol/cm²);

q represents the sectional area of the cell (cm²);

t represents the diffusion time (sec); and

D represents the diffusion constant (cm²/sec).

The characteristic feature of the dispersion method of the functional compound of the present invention is that the compound is dispersed in water or a hydrophilic colloid solution with water or a water-soluble organic solvent. The water-soluble organic solvent is an organic solvent having a solubility in water of about 5% or more, or that is, having a sufficient solubility to be capable of being dissolved in water or a dispersion medium-containing solution, such as hydrophilic colloid solution. For example, the compound can be dissolved in an alcohol (such as methanol, ethanol, etc.), a ketone (such as acetone, methyl ethyl ketone, etc.), dimethylformamide or dimethylsulfoxide, and then dispersed in water or in a hydrophobic colloid solution. The organic solvent used is preferably removed by evaporation under reduced pressure or ultrafiltration, after the solution has been dispersed. Accordingly, the solvent preferably has a boiling point of 150° C. or lower at normal pressure and can be used with ease. The dispersion method of the present invention is different from a conventional so-called "Fisher dispersion". The dispersion method of the present invention has a neutral, or preferably acidic pH range. Preferably, the functional compound of the present invention is dispersed together with an organic acid, such as citric acid, oxalic acid, acetic acid, tartaric acid, succinic acid, malic acid, etc. The chemical stability of the compound itself and the stability of the resulting dispersion are important for the prevention of the sedimentation of the dispersed phase. The dispersion method of the present invention differs from a so-called "Fisher dispersion", in that a pair ion to the water-soluble group (i.e., an anion) in the functional compound, is important. In particular, $Na^+$, $K^+$, $Li^+$, $NH_4^+$, $(C_2H_5)_3N^+H$, etc. are useful in this regard.

After the functional compound of the present invention has a been dispersed in water or in a hydrophilic colloid solution, the resulting dispersion is blended further with a hydrophilic colloid solution (necessarily in the former case but optionally in the latter case), and then the resulting blend is coated on a support or in any other coat layer.

The compound of the present invention can be dispersed together with a reducing substance and incorporated into the hydrophilic colloid layer, if desired. In this case, the reducing substance to be used desirably contains at least one water-soluble group, preferably a sulfone group or a salt thereof, a carboxyl group or a salt thereof, etc. For example, S-67, S-68, S-69 and S-72 set forth below are preferred.

First, the hydrophilic colloid layer in the material of the present invention can easily be attacked by a reducing substance, since the functional compound of the present invention has directly been dispersed in the hydrophilic colloid, so that efficient cleavage of the functional compound and the successive release of the photographically useful group from the compound may be accomplished with ease. Second, the functional compound can be stably dispersed in the hydrophilic colloid with ease. Further, even though the compound is a relatively low molecular weight compound, it hardly diffuses to the adjacent layers. Third, the compound does not directly require an oil or similar dispersion medium for the dispersion thereof, and therefore, the colloid layer can contain the compound in a high density and the layer thickness may be thin. These are advantageous characteristics attainable by the present invention.

The dispersion method of the functional compound of the present invention can be carried out together with any other so-called oil dispersion method or polymer dispersion method and is therefore, advantageous for stabilization of the resulting oil dispersion or polymer dispersion. The functional compound of the present invention will be specifically described below. The functional compound is represented by formula (I):

$$\text{PWR-(Time)}_r\text{PUG} \qquad \text{(I)}$$

In formula (I), PWR may be either a moiety corresponding to an electron-accepting center and an intramolecular nucleophilic substitution reaction center in a compound capable of releasing a photographic reagent by intramolecular nucleophilic substitution reaction after reduction, such as described in U.S. Pat. Nos. 4,139,389 and 4,139,379 and Japanese Patent Application (OPI) No. 85333/84 (the term "OPI" as used herein means a "published unexamined Japanese patent application"), or a moiety corresponding to an electron-accepting quinonoid center and a carbon atom to bind the said center and a photographic reagent group in a compound capable of releasing the said photographic reagent by intramolecular electron transfer reaction after reduction, such as described in U.S. Pat. No. 4,232,107 or Japanese Patent Application (OPI) Nos. 101649/84 and 88257/86. Further PWR may also be a moiety corresponding to an electron-attractive group-substituted aryl group and an atom (e.g., a sulfur atom, carbon atom or nitrogen atom) to bind the said group and a photographic reagent group in a compound capable of releasing the said photographic reagent by cleavage of the single bond therein after reduction, such as described in Japanese Patent Application (OPI) No. 42530/81 or U.S. Pat. Nos. 4,343,893 and 4,619,884. In addition, it may also be either a moiety corresponding to a nitro group and a carbon atom to bind the said group and a photographic reagent group in a nitro compound capable of releasing the said photographic reagent after an electron accepting reaction, such as described in U.S. Pat. No. 4,450,223, or a moiety corresponding to a Geminaldinitro group and a carbon atom to bind the said group and a photographic reagent group in a dinitro compound capable of $\beta$-eliminating the s id described in U.S. Pat. No. 4,609,610.

In order to more sufficiently attain the object of the present invention, the compounds represented by the formula (II) are preferred among the compounds of formula (I).

II

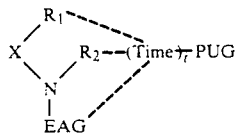

In the formula (II), the moiety of

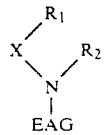

corresponds to PWR in formula (I). In this case, $(\text{Time})_r\text{PUG}$ is bonded lo at least one of $R_1$, $R_2$ or EAG.

The moiety corresponding to PWR in formula (II) is described below.

Dotted lines mean that at least one of them represents a chemical bond.

X represents an oxygen atom (—O—), a sulfur atom (—S—) or a nitrogen-containing group (—N($R_3$)—).

$R_1$, $R_2$ and $R_3$ each represent a group except a hydrogen atom, or may be a chemical bond.

Examples of $R_1$, $R_2$ and $R_3$ each of which is a group except hydrogen are as follows:

Alkyl Groups and Aralkyl Groups (optionally substituted alkyl groups and aralkyl groups, such as a methyl group, a trifluoromethyl group, a benzyl group, a chloromethyl group, a dimethylaminomethyl group, an ethoxycarbonylmethyl group, an aminomethyl group, an acetylaminomethyl group, an ethyl group, a 2-(4-dodecanoylaminophenyl)ethyl group, a carboxyethyl group, an allyl group, a 3,3,3-trichloropropyl group, an n-propyl group, an iso-propyl group, an n-butyl group, an isobutyl group, a sec-butyl group, a t-butyl group, an n-pentyl group, a sec-pentyl group, a t-pentyl group, a cyclopentyl group, an n-hexyl group, a sec-hexyl group, a t-hexyl group, a cyclohexyl group, an n-octyl group, a sec-octyl group, a t-octyl group, an n-decyl group, an n-undecyl group, an n-dodecyl group, an n-tetradecyl group, an n-pentadecyl group, an n-hexadecyl group, a sec-hexadecyl group, a t-hexadecyl group, an n-octadecyl group, a t-octadecyl group, etc.);

Alkenyl Groups (optionally substituted alkenyl groups, e.g., a vinyl group, a 2-chlorovinyl group, a 1-methylvinyl group, a 2-cyanovinyl group, a cyclohexen-1-yl group, etc.);

Alkynyl Groups (optionally substituted alkynyl groups, e.g., an ethynyl group, a 1-propynyl group, a 2-ethoxycarbonylethynyl group, etc.)

Aryl Groups (optionally substituted aryl groups, e.g., a phenyl group, a naphthyl group, a 3-hydroxyphenyl group, a 3-chlorophenyl group, a 4-acetylaminophenyl group, a 4-hexadecansulfonylaminophenyl group, a 2-methanesulfonyl-4-nitrophenyl group, a 3-nitrophenyl group, a 4-methoxyphenyl group, a 4-cyanoacetylaminophenyl group, a 4-methanesulfonylphenyl group, a 2,4-dimethylphenyl group, a 4-tetradecyloxyphenyl group, etc.);

Heterocyclic Groups (optionally substituted heterocyclic groups, e.g., a 1-imidazolyl group, a 2-furyl group, a 2-pyridyl group, a 5-nitro-2-pyridyl group, a 3-pyridyl group, a 3,5-dicyano-2-pyridyl group, a 5-tetrazolyl group, a 5-phenyl-1-tetrazolyl group, a 2-benzothiazolyl group, a 2-benzimidazolyl group, a 2-benzoxazolyl group, a 2-oxazolin-2-yl group, a morpholino group, etc.);

Acyl Groups (optionally substituted acyl groups, e.g., an acetyl group, a propionyl group, a butyroyl group, an isobutyroyl group, a 2,2-dimethylpropionyl group, a benzoyl group, a 3,4-dichlorobenzoyl group, a 3-acetylamino-4-methoxybenzoyl group, a 4-methylbenzoyl group, a 4-methoxy-3-sulfobenzoyl group, etc.);

Sulfonyl Groups (optionally substituted sulfonyl groups, e.g., a methanesulfonyl group, an ethanesulfonyl group, a chloromethanesulfonyl group, a propanesulfonyl group, a butanesulfonyl group, an n-octanesulfonyl group, a n-dodecanesulfonyl group, an n-hexadecanesulfonyl group, a benzenesulfonyl group, a 4-toluenesulfonyl group, a 4-n-dodecyloxybenzenesulfonyl group, etc.);

Carbamoyl Groups (optionally substituted carbamoyl groups, e.g., a carbamoyl group, a methylcarbamoyl group, a dimethylcarbamoyl group, a bis-(2-methoxyethyl)carbamoyl group, a diethylcarbamoyl group, a cyclohexylcarbamoyl group, a di-n-octylcarbamoyl group, a 3-dodecyloxypropylcarbamoyl group, a hexadecylcarbamoyl group, a 3-(2,4-di-t-pentylphenoxy)-propylcarbamoyl group, a 3-octanesulfonylaminophenylcarbamoyl group, a di-n-octadecylcarbamoyl group, etc.);

Sulfamoyl Groups (optionally substituted sulfamoyl groups, e.g., a sulfamoyl group, a methylsulfamoyl group, a dimethylsulfamoyl group, a diethylsulfamoyl group, a bis-(2-methoxyethyl)-sulfamoyl group, a di-n-butylsulfamoyl group, a methyl-n-octylsulfamoyl group, an n-hexadecylsulfamoyl group, a 3-ehoxypropylmethylsulfamoyl group, an N-phenyl-N-methylsulfamoyl group, a 4-decyloxyphenylsulfamoyl group, a methyloctadecylsulfamoyl group, etc.).

$R_1$ and $R_3$ are preferably a substituted or unsubstituted alkyl, alkenyl, alkynyl, aryl, heterocyclic, acyl or sulfonyl group.

It is preferred that $R_1$ and $R_3$ each have from 1 to 40 carbon atoms. $R_2$ is preferably a substituted or unsubstituted acyl or sulfonyl group. As examples of $R_2$, the same acyl and sulfonyl groups as mentioned for the aforesaid $R_1$ and $R_3$ may be referred to. It is preferred that these groups each have from 1 to 40 carbon atoms. $R_1$, $R_2$, $R_3$ and EAG may be connected to form a ring.

EAG is described below.

In order to more advantageously attain the objects of the present invention, the compounds as represented by formula (III) are preferred among the compounds of formula (II):

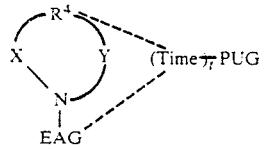

(III)

In formula (III), the moiety of:

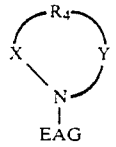

corresponds to PWR in formula (I). In this case, $(Time)_r$PUG is bonded to at least one of $R_4$ and EAG.

The moiety corresponding to the group PWR in formula (III) will be explained below.

Dotted lines mean that at least one of them represents a chemical bond.

Y represents a divalent linking group and is preferably —(C=O)— or —$SO_2$—. X has the same meaning as set forth in formula (II).

$R_4$ is bonded to X and Y and represents an atomic group for forming a 5-membered to 8-membered mono- or condensed-heterocyclic ring together with the nitrogen atom in the formula.

Preferred examples of the heterocyclic rings for the above-noted moiety are set forth below.

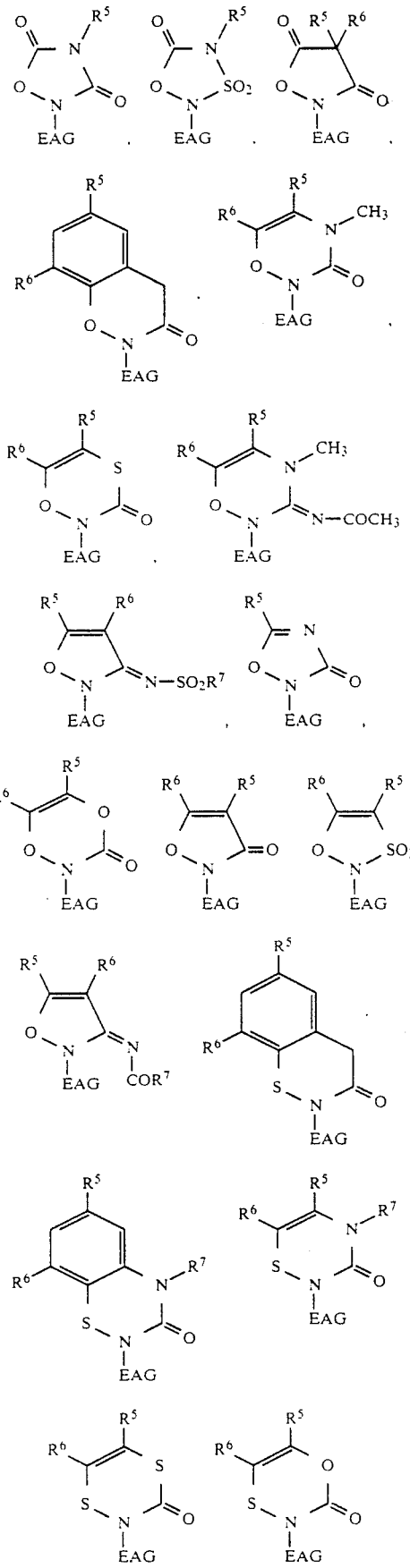
-continued
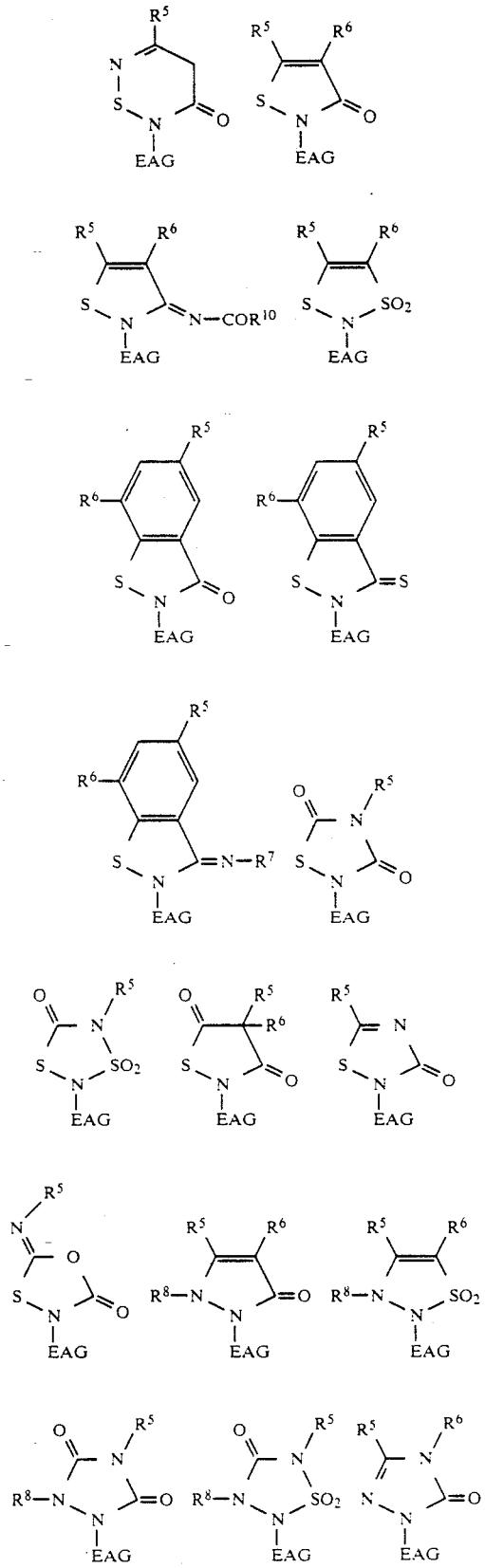

-continued

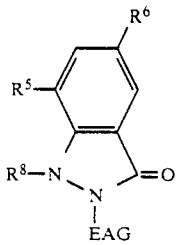

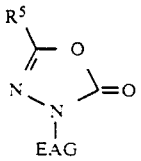

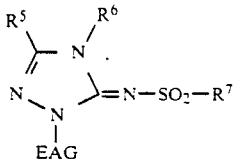

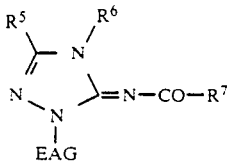

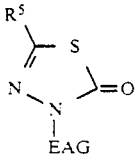

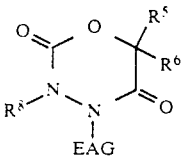

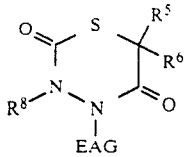

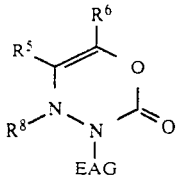

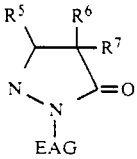

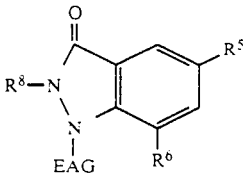

In these formulae, $R^5$, $R^6$ and $R^7$ each preferably represents a hydrogen atom, an alkyl group, an aryl group or a heterocyclic group; and $R^8$ preferably represents an acyl group or sulfonyl group. $R^5$, $R^6$, $R^7$ and $R^8$ each preferably has from 1 to 40 carbon atoms, and more preferably from 1 to 20 carbon atoms.

More preferred examples of the compounds of the present invention are mentioned below, including the position of the bond of the group $(Time)_r$PUG. However, these examples are not intended to limit the scope of the present invention.

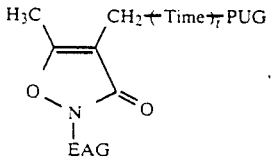

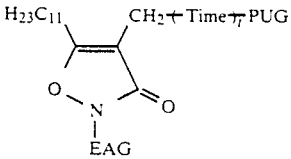

-continued

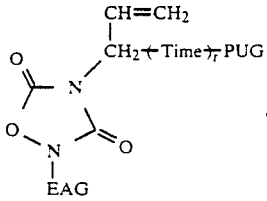

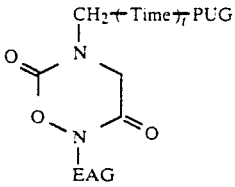

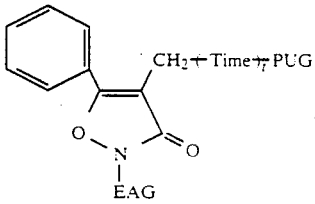

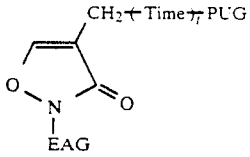

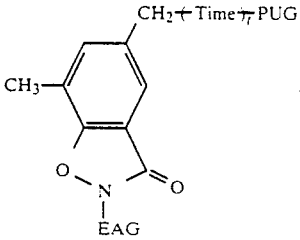

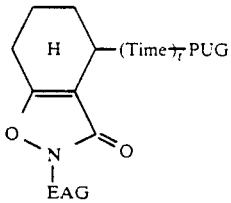

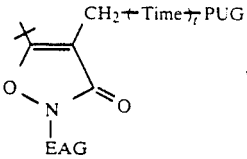

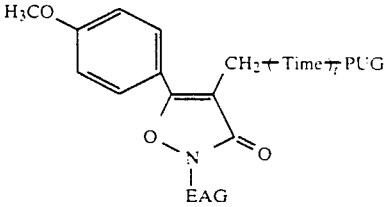

-continued

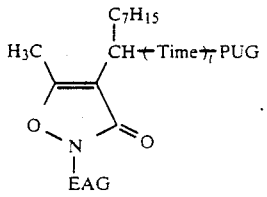

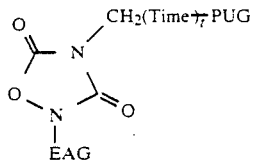

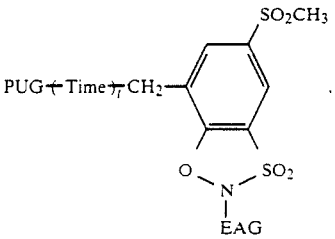

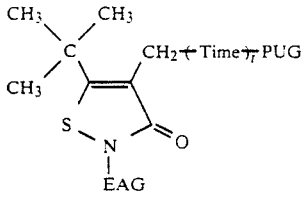

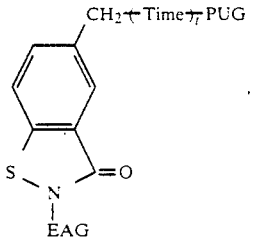

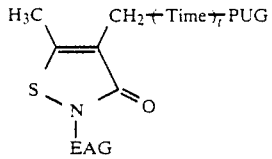

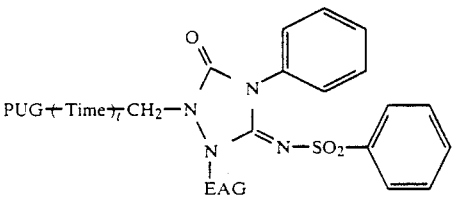

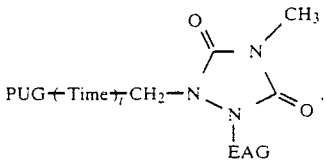

-continued

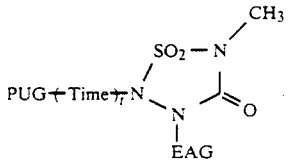

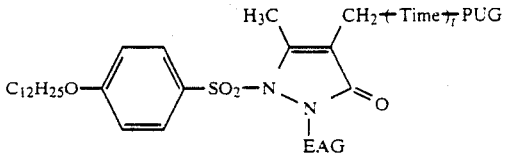

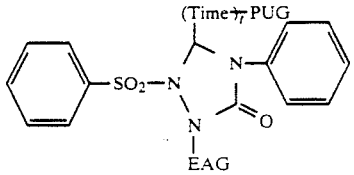

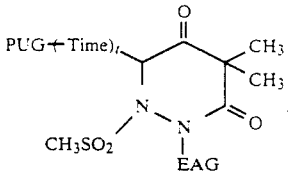

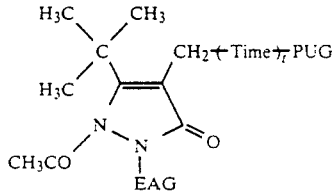

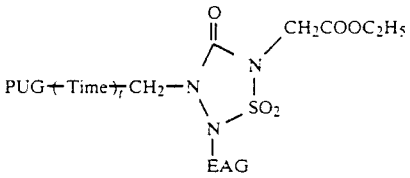

More specific compounds of the present invention will be described hereinafter.

EAG represents an aromatic group capable of accepting an electron from a reducing substance, and this is bonded to the nitrogen atom in the molecule. EAG is preferably a group represented by formula (A):

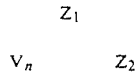

(A)

In formula (A), $Z_1$ represents

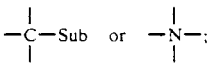

$V_n$ represents an atomic group for forming a 3-membered to 8-membered aromatic group together with $Z_1$ and $Z_2$; and n represents an integer of from 3 to 8.

Accordingly, $V_n$ includes the following groups. $V_3$; $—Z_3—$, $V_4$; $—Z_3—$, $V_4$; $—Z_3—Z_4—$, $V_5$; $—Z_3—Z_4—Z_5—$, $V_6$; $—Z_3—Z_4—Z_5—Z_6—$, $V_7$; $—Z_3—Z_4—Z_5—Z_6—Z_7—$ and $V_8$; $—Z_3—Z_4—Z_5—Z_6—Z_7—Z_8—$. $Z_2$ to $Z_8$ each represent

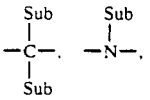

—O—, —S— or $—SO_2—$; and Sub represents a chemical bond ($\pi$-bond), a hydrogen atom or the substituent mentioned below. The Sub's may be the same or different, may be bonded together to form a 3-membered to 8-membered saturated or unsaturated carbon-ring or heterocyclic ring.

In formula (A), Sub's are preferably so selected that the sum of Hammett's substituent constants ($\sigma_{para}$) of the substituents are +0.50 or more, more preferably +0.70 or more, and more preferably +0.85 or more.

EAG is explained in more detail below.

EAG represents a group capable of accepting an electron from a reducing substance and is bonded to the nitrogen atom in the molecule. EAG is preferably an aryl or heterocyclic group substituted by at least one electron attractive group. The substituents bonded to the aryl or heterocyclic group of EAG can be utilized for adjusting the total properties of the compound. For example, these substituents can be utilized for adjusting the electron-acceptability of the compound as the generic property of the compound as well as for adjusting the water-solubility, oil-solubility, diffusibility, sublimation capacity, melting point, dispersibility in binders such as gelatin, reactivity to nucleophilic groups, reactivity to electrophilic groups, etc., of the compound.

In the present invention, EAG preferably represents an aryl or heterocyclic group substituted by at least one of a cyano group, a nitro group and a trifluoromethanesulfonyl group.

Specific examples of EAG are set forth below. As examples of aryl groups substituted by at least one electron-attractive group, there are, for example, a 4-nitrophenyl group, a 2-nitrophenyl group, a 2-nitro-4-N-methyl-N-n-butylsulfamoylphenyl group, a 2-nitro-4-N-methyl-N-n-octylsulfamoylphenyl group, a 2-nitro-4-N-methyl-N-n-dodecylsulfamoylphenyl group, a 2-nitro-4-N-methyl-N-n-hexadecylsulfamoylphenyl group, a 2-nitro-4-N-methyl-N-n-octadecylsulfamoylphenyl group, a 2-nitro-4-N-methyl-N-(3-carboxypropyl)sulfamoylphenyl group, a 2-nitro-4-N-ethyl-N-(2-sulfoethyl)sulfamoylphenyl group, a 2-nitro-4-N-n-hexadecyl-N-(3-sulfopropyl)sulfamoylphenyl group, a 2-nitro-4-N-(2-cyanoethyl)-N-((2-hydroxyethoxy)ethyl)sulfamoylphenyl group, a 2-nitro-4-diethylsulfamoylphenyl group, a 2-nitro-4-di-n-butylsulfamoylphenyl group, a 2-nitro-4-di-n-octylsulfamoylphenyl group, a 2-nitro-4-di-n-octadecylsulfamoylphenyl group, a 2-nitro-4-methylsulfamoylphenyl group, a 2-nitro-4-n-hexadecylsulfamoylphenyl group, a 2-nitro-4-N-methyl-N-(4-dodecylsulfonylphenyl)sulfamoylphenyl group, a 2-nitro-4-(3-methylsulfamoylphenyl)sulfamoylphenyl group, a 4-nitro-2-N-methyl-N-n-butylsulfamoylphenyl group, a 4-nitro-2-N-methyl-N-n-octylsulfamoylphenyl group, a 4-nitro-2-N-methyl-N-n-dodecylsulfamoylphenyl group, a 4-nitro-2-N-methyl-N-n-hexadecylsulfamoylphenyl group, a 4-nitro-2-N-methyl-N-n-octadecylsulfamoylphenyl group, a 4-nitro-2-N-(3-carboxypropyl)sulfamoylphenyl group, a 4-nitro-2-N-ethyl-N-(2-sulfoethyl)sulfamoylphenyl group, a 4-nitro-2-N-n-hexadecyl-N-(3-sulfopropyl)sulfamoylphenyl group, a 4-nitro-2-N-(2-cyanoethyl)-N-(2-hydroxyethoxyethyl)sulfamoylphenyl group, a 4-nitro-2-diethylsulfamoylphenyl group, a 4-nitro-2-di-n-butylsulfamoylphenyl group, a 4 nitro-2-di-n-octylsulfamoylphenyl group, a 4-nitro-2-di-n-octadecylsulfamoylphenyl group, a 4-nitro-2-methylsulfamoylphenyl group, a 4-nitro-2-n-hexadexylsulfamoylphenyl group, a 4-nitro-2-N-methyl N-(4-dodecylsulfonylphenyl)sulfamoylphenyl group, a 4-nitro-2-(3-methylsulfamoylphenyl)sulfamoylphenyl group, a 4-nitro-2 chlorophenyl group, a 2-nitro-4-chlorophenyl group, a 2-nitro-4-N-methyl-N-n-butylcarbamoylphenyl group, a 2-nitro-4-N-methyl-N-n-octylcarbamoylphenyl group, a 2-nitro-4-N-methyl-N-n-dodecylcarbamoylphenyl group, a 2-nitro-4-N-methyl-N-n-hexadecylcarbamoylphenyl group, a 2-nitro-4-N-methyl-N-n-octadecylcarbamoylphenyl group, a 2 nitro-4-N-methyl-N-(3-carboxypropyl)carbamoylphenyl group, a 2-nitro-4-N-ethyl-N-(2-sulfoethyl)carbamoylphenyl group, a 2-nitro-4-N-n-hexadecyl-N-(3-sulfopropyl)carbamoylphenyl group, a 2-nitro-4-N-(2-cyanoethyl)-N-((2-hydroxyethoxy)ethyl)carbamoylphenyl group, a 2-nitro-4-diethylcarbamoylphenyl group, a 2 nitro-4-di-n-butylcarbamoylphenyl group, a 2-nitro-4-di-n-octylcarbamoylphenyl group, a 2-nitro-4-di-n-octadecylcarbamoylphenyl a 2-nitro-4-methylcarbamoylphenyl group, a 2-nitro-4-n-hexadecylcarbamoylphenyl group, a 2-nitro-4-N-methyl-N-(4-dodecylsulfonylphenyl)carbamoylphenyl group, a 2-nitro-4-(3-methylsulfamoylphenyl)carbamoylphenyl group, a 4-nitro-2-N-methyl-N-n-butylcarbamoylphenyl group, a 4-nitro-2 N-methyl-N-n-octylcarbamoylphenyl group, a 4-nitro-2-N-methyl-N-n-dodecylcarbamoylphenyl group, a 4-nitro-2-N-methyl-N-n-hexadecylcarbamoylphenyl group, a 4-nitro-2-N-methyl-N-n-octadecylcarbamoylphenyl group, a 4-nitro-2-N-methyl-N-(3-carboxypropyl)carbamoylphenyl group, a 4-nitro-2-N-ethyl-N-(2-sulfoethyl)carbamoylphenyl group, a 4-nitro-2-N-n-hexadecyl-N-(3-sulfopropyl)carbamoylphenyl group, a 4-nitro-2-N-(2-cyanoethyl)-N-((2-hydroxyethoxy)ethyl)-carbamoylphenyl group, a 4-nitro-2-diethylcarbamoylphenyl group, a 4-nitro-2-di-n-butylcarbamoylphenyl group, a 4-nitro-2-di-n-octylcarbamoylphenyl group, a 4-nitro-2-di-n-octadecylcarbamoylphenyl group, a 4-nitro-2-methylcarbamoylphenyl group, a 4-nitro-2-n-hexadecylcarbamoylphenyl group, a 4-nitro-2-N-methyl-N (4-dodecylsulfonylphenyl)carbamoylphenyl group, a 4-nitro-2-(3-methylsulfamoylphenyl)carbamoylphenyl group, a 2,4-dimethanesulfonylphenyl group, a 2-methanesulfonyl-4-benzenesulfonylphenyl group, a 2-n-octanesulfonyl-4-methanesulfonylphenyl group, a 2-n-tetradecanesulfonyl-4-methanesulfonylphenyl group, a 2-n-hexadecanesulfonyl-4-methanesulfonylphenyl group, a 2,4-di-n-dodecanesulfonylphenyl group, a 2,4-didodecanesulfonyl-5-trifluoromethylphenyl group, a 2-n-decanesulfonyl-4-cyano-5-trifluoromethylphenyl group, a 2-cyano-4-methanesulfonylphenyl group, a 2,4,6-tricyanophenyl group, a 2,4-dicyanophenyl group, a 2-nitro-4-methanesulfonylphenyl group, a 2-nitro-4-n-dodecanesulfonylphenyl group, a 2-nitro-4-(2-sulfoethylsulfonyl)phenyl group, a 2 nitro-4-carboxymethylsulfonylphenyl group, a 2-nitro-4-carboxyphenyl group, a 2-nitro-4-ethoxycarbonyl-5-n-butoxyphenyl group, a 2-nitro-4-ethoxycarbonyl-5-n-hexadecyloxyphenyl group, a 2-nitro-4-diethylcarbamoyl-5-n-hexadecyloxyphenyl group, a 2-nitro-4-cyano-5-n-dodecylphenyl group, a 2,4-dinitrophenyl group, a 2-nitro-4-n decylthiophenyl group, a 3,5-dinitrophenyl group, a 2-nitro-3,5-dimethyl-4-n-hexadecanesulfonylphenyl group, a 4-methanesulfonyl-2-benzene-sulfonylphenyl group, a 4-n-octanesulfonyl 2-methanesulfonylphenyl group, a 4-n-tetradecanesulfonyl-2-methanesulfonylphenyl group, a 4-n-hexadecanesulfonyl-2-methanesulfonylphenyl group, a 2,5-didodecanesulfonyl-4-trifluoromethylphenyl group, a 4-n-decanesulfonyl-2-cyano-5-trifluoromethylphenyl group, a 4-cyano-2-methanesulonylphenyl group, a 4-nitro-2-methanesulfonylophenyl group, a 4-nitro-2-n-dodecanesulfonylphenyl group, a 4-nitro-2-(2-sulfoethylsulfonyl)phenyl group, a 4-nitro-2-carboxymethylsulfonylphenyl group, a 4-nitro-2-carboxyphenyl group, a 4-nitro-2-ethoxycarbonyl-5-n-butoxyphenyl group, a 4-nitro-2-ethoxycarbonyl-5-n-hexadecyloxyphenyl group, a 4-nitro-2-diethylcarbamoyl-5-n-hexadecyloxyphenyl group, a 4-nitro-2-cyano-5-n-dodecylphenyl group, a 4-nitro-2-n-decylthiophenyl group, a 4-nitro-3,5-dimethyl-2-n-hexadecanesulfonylphenyl group, a 4-nitronaphthyl group, a 2,4-dinitronaphthyl group, a 4-nitro-2-n-octadecylcarbamoylnaphthyl group, a 4-nitro-2-dioctylcarbamoyl-5-(3-sulfobenzenesulfonylamino)naphthyl group, a 2,3,4,5,6-pentafluorophenyl group, a 2-nitro-4-benzoylphenyl group, a 2,4-diacetylphenyl group, a 2-nitro-4-trifluoromethylphenyl group, a 4-nitro-2-trifluoromethylphenyl group, a 4-nitro-3-trifluoromethylphenyl group, a 2,4,5-tricyanophenyl group, a 3,4-dicyanophenyl group, a 2-chloro-4,5-dicyanophenyl group, a 2-bromo-4,5-dicyanophenyl group, a 4-methanesulfonylphenyl group, a 4-n-hexadecanesulfonylphenyl group, a 2-decanesulfonyl-5-trifluoromethylphenyl group, a 2-nitro-5-methylphenyl group, a 2-nitro-5-n-octadecyloxyphenyl group, a 2-nitro-4-N-(vinylsulfonylethyl)-N-methylsulfamoylphenyl group, a 2-methyl-6-nitrobenzoxazol-5-yl group, etc.

As examples of heterocyclic groups, there are, for example, a 2-pryridyl group, a 3-pyridyl group, a 4-pyridyl group, a 5-nitro-2-pyridyl group, a 5-nitro-N-hexadecylcarbamoyl-2-pyridyl group, 3,5-dicyano-2-pyridyl group, a 5-dodecanesulfonyl-2-pyridyl group, a 5-cyano-2-pyrazyl, a 4-nitrothiophen-2-yl group, a 5-nitro-1,2-dimethylimidazol-4-yl group, a 3,5-diacetyl-2-pyridyl group, a 1-dodecyl-5-carbamoylpyridinium-2-yl group, a 5-nitro-2-furyl group, a 5-nitrobenzothiazol-2-yl group, etc.

Next, -(Time)$_r$-PUG will be explained in detail.

Time represents a group capable of releasing PUG, as triggered by the cleavage of the nitrogen-oxygen, nitrogen-nitrogen or nitrogen-sulfur bond, via the successive reaction (e.g., an intramolecular nucleophilic substitution reaction and an intramolecular electron transfer reaction).

Various groups are known for Time, and for example, there may be used the group described in Japanese Patent Application (OPI) Nos. 147244/86, pages 5 to 6, 2364549/86, pages 8 to 14, etc.

PUG represents a photographically useful group, either as Time-PUG or PUG.

The photographically useful group includes, for example, development inhibitors, development accelerators, nucleating agents, couplers, diffusive or non-diffusive dyes, desilvering accelerators, desilvering inhibitors, silver halide solvents, competing compounds, developing agents, development aids, fixation accelerators, fixation inhibitors, image stabilizers, toning agents, process-dependency improving agents, dot improving agents, color image stabilizers, photographic dyes, surfactants, hardening agents, desensitizing dyes, contrast enhancing agents, chelating agents, brightening agents, ultraviolet absorbents, etc., as well as precursors thereof.

Specific examples of PUG can be selected from the compounds described in, for example, Japanese Patent Application Nos. 215270/87, 244044/87 and 245256/87.

Specific examples of Time and PUG include Time and PUG described in U.S. patent application Ser. No. 925,350 (filed on Oct. 30, 1986), now U.S. Pat. No. 4,783,396, and Time described in European Patent Application 220,746A2, pages 11 to 22 and PUG described in European Patent Application 220,746A2, pages 22 to 41.

The compounds of the present invention have the water-soluble group(s) mentioned above. The position for the water-soluble substituent group may be in anyone of PWR, Time and PUG, but is preferably in PUG.

Examples of the functional compounds for use in the present invention are set forth below, however, the present invention should not be construed as being limited thereto.

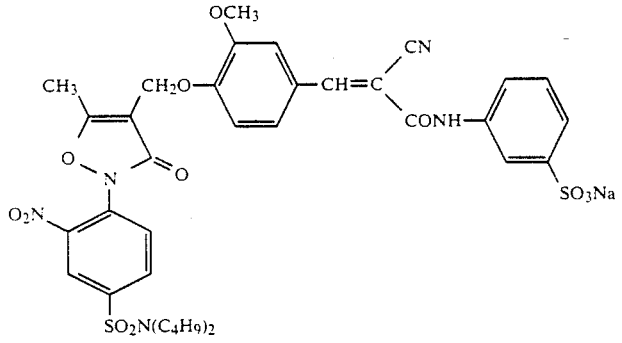

-continued
2
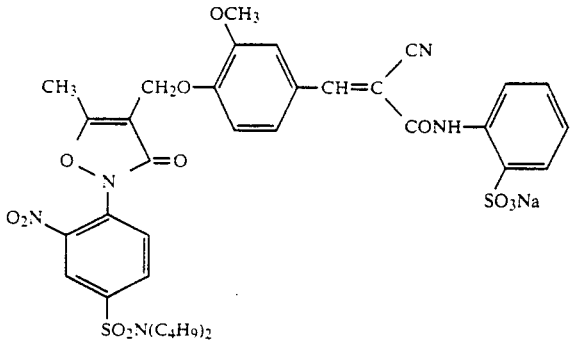
3
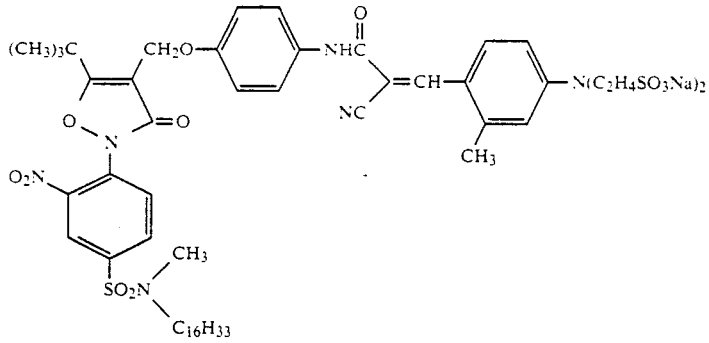
4
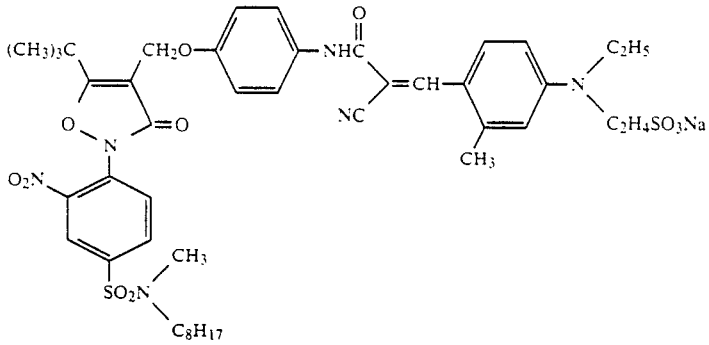
5
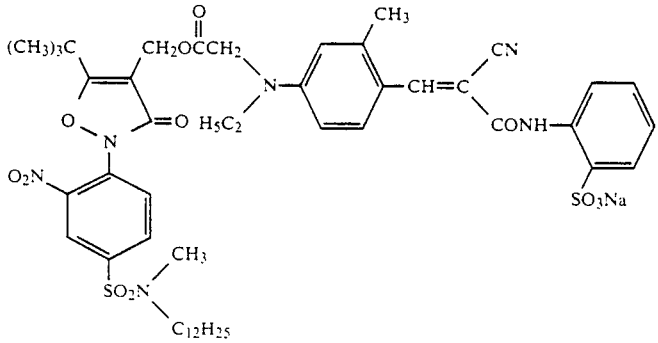

-continued
6
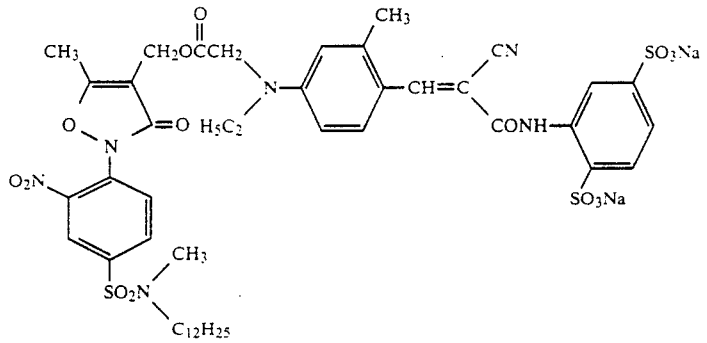
7
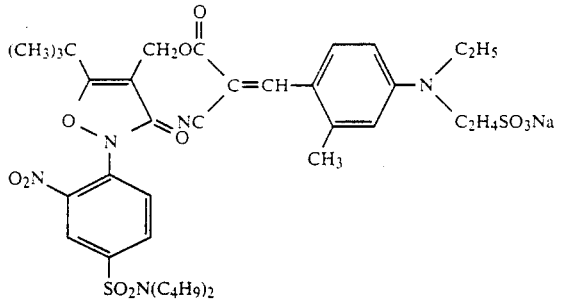
8
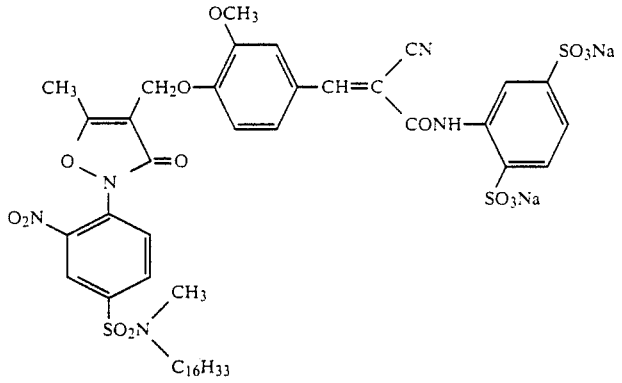
9
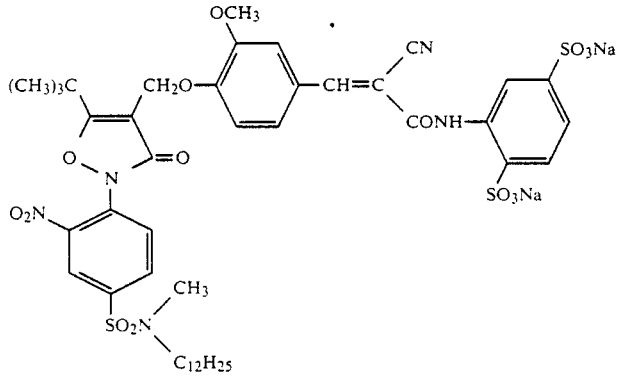

-continued
10
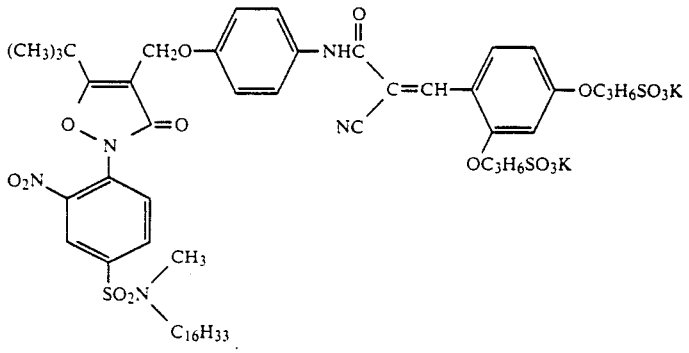
11
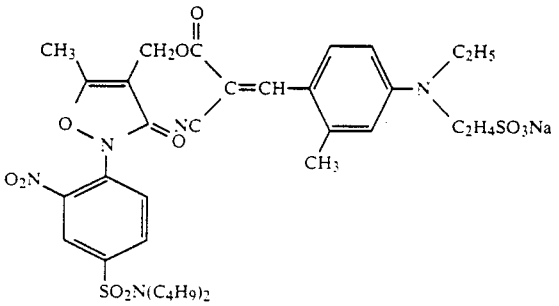
12
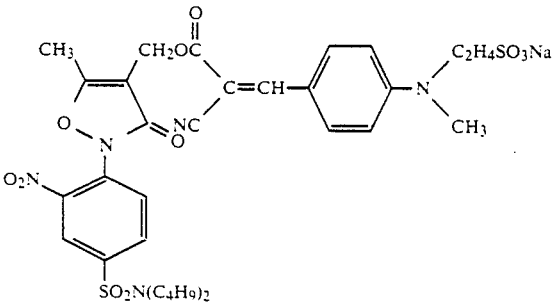
13
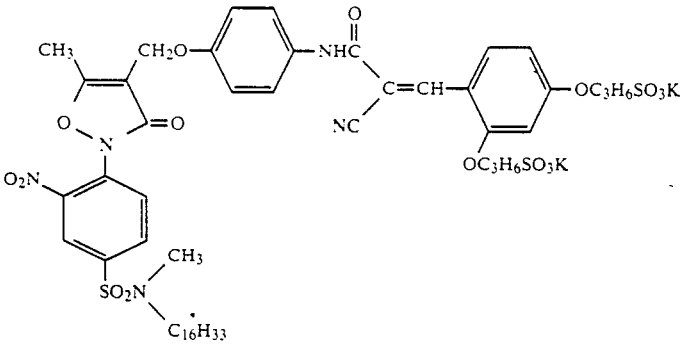
14
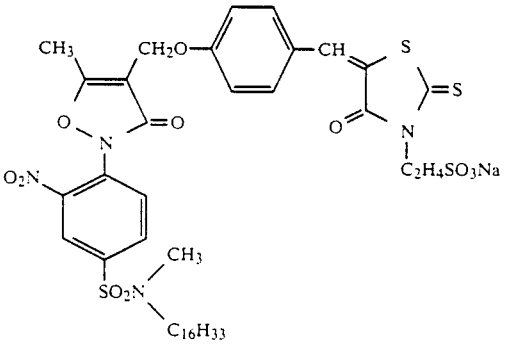

-continued
15
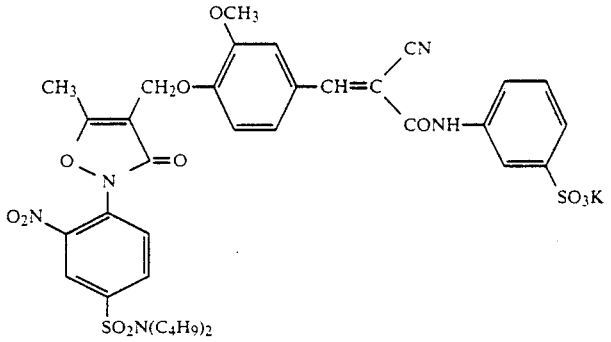
16
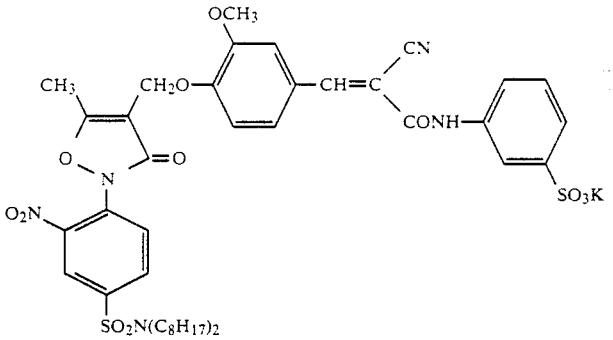
17
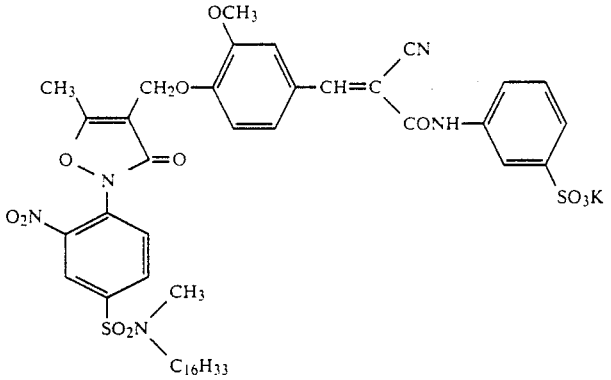
18
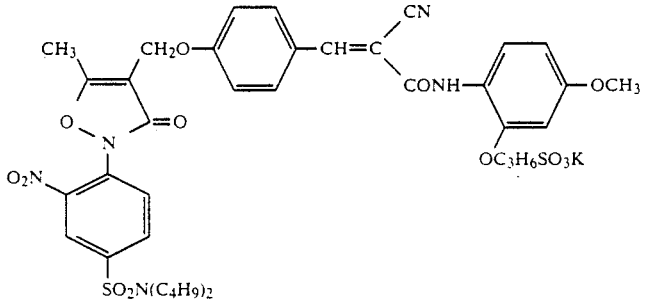

-continued
19
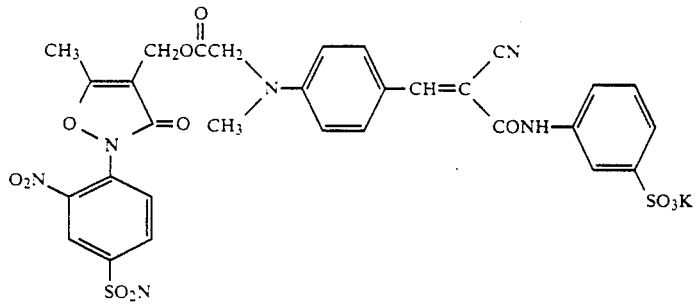
20
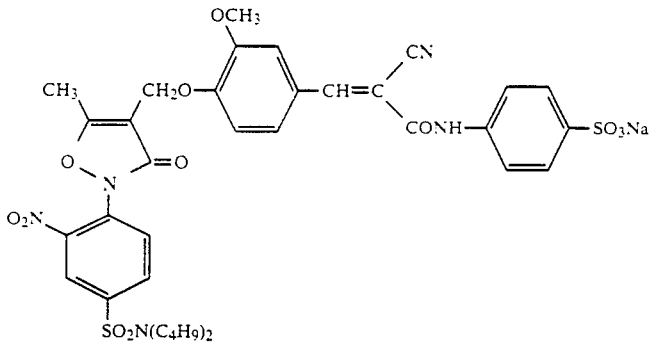
21
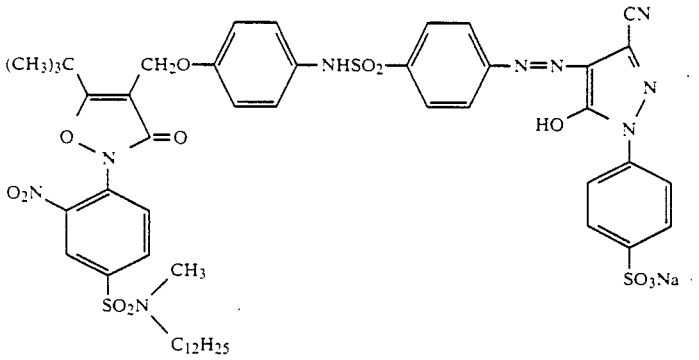
22
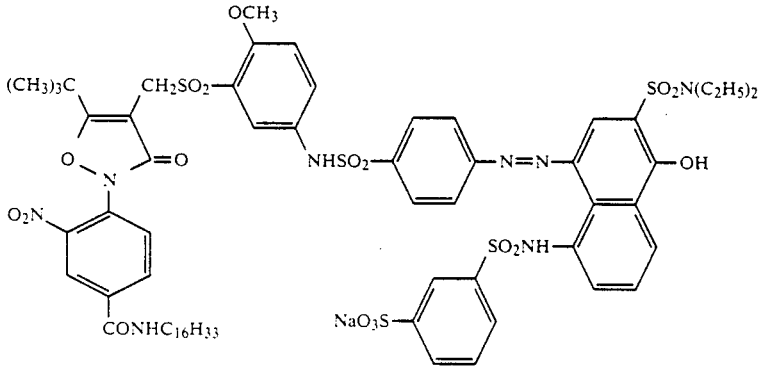

-continued
23
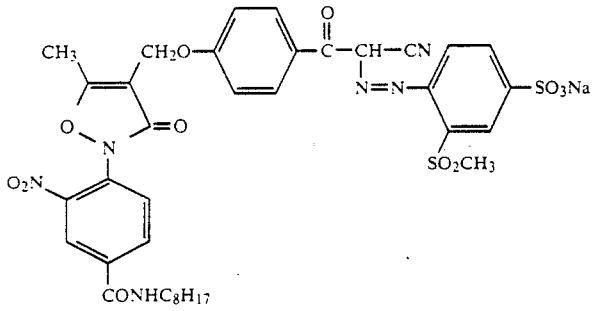
24
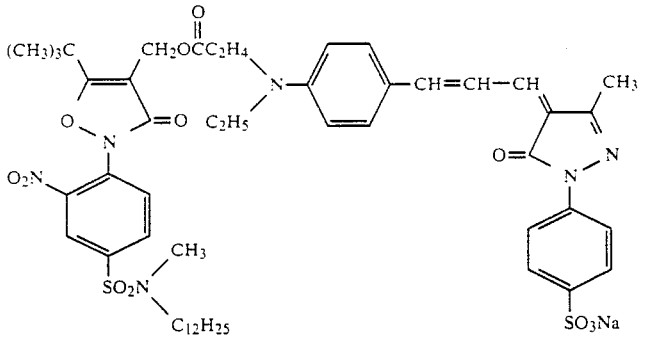
25
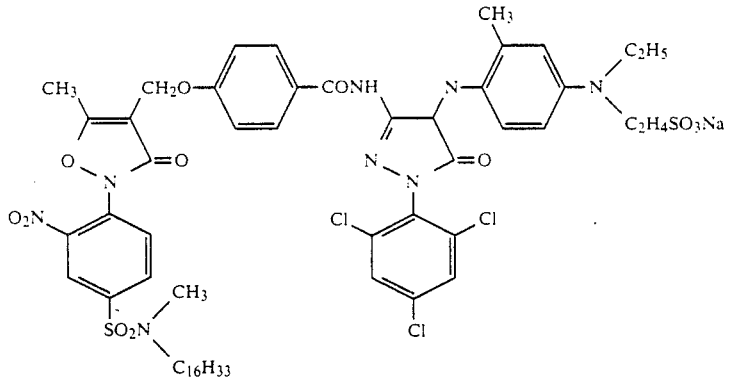
26
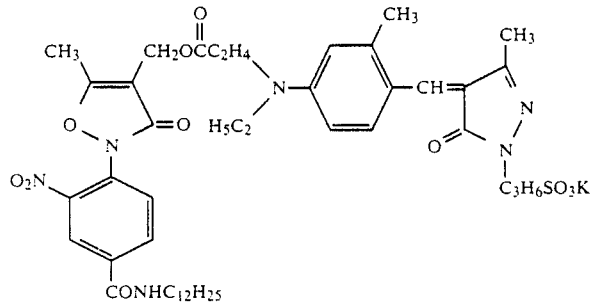

-continued
27
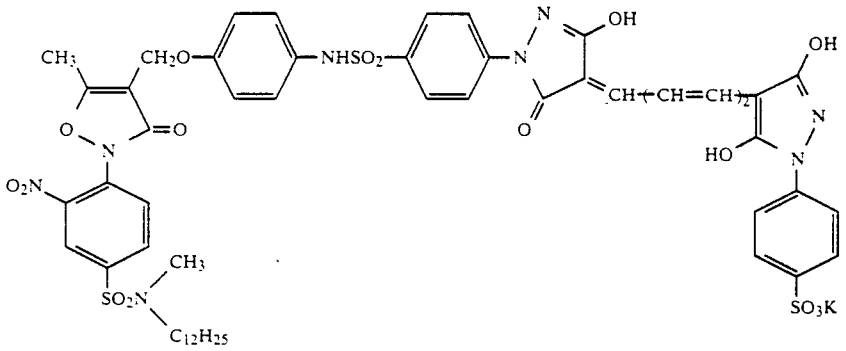
28
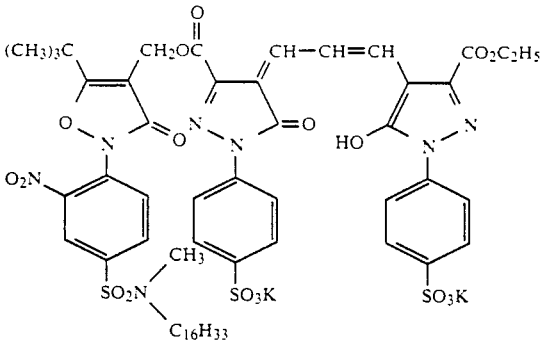
29
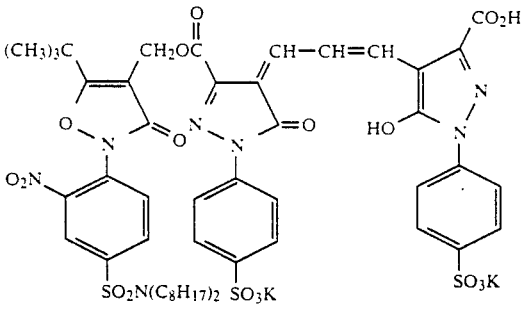
30
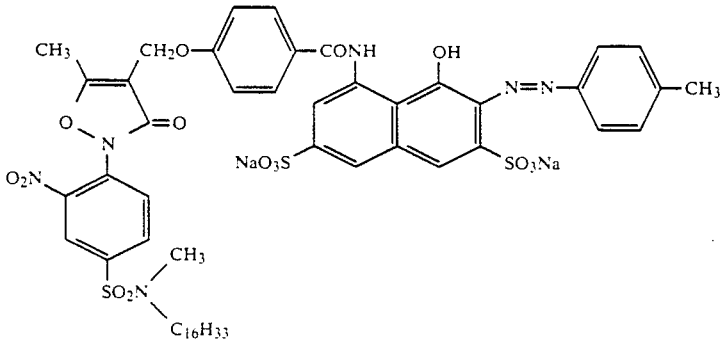

-continued
31
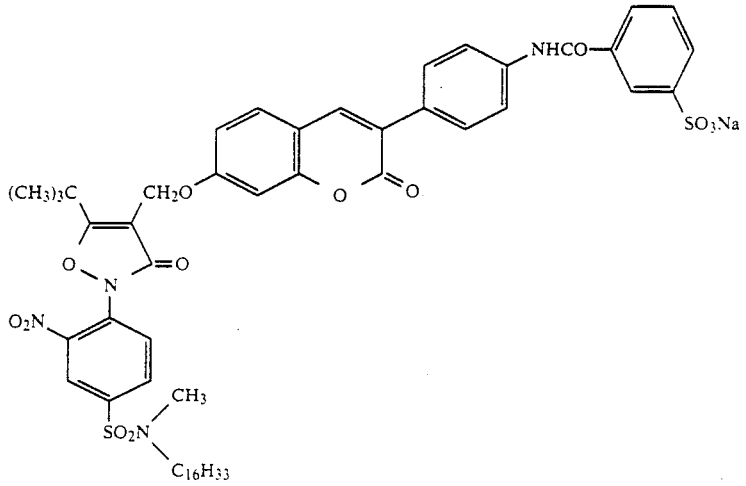
32
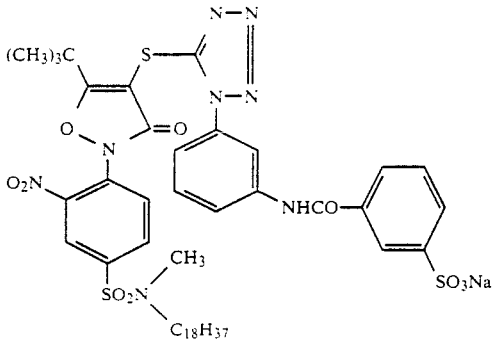
33
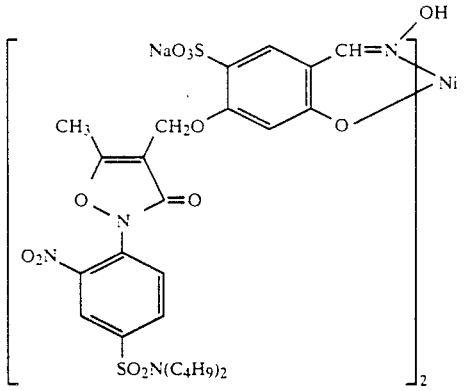
34
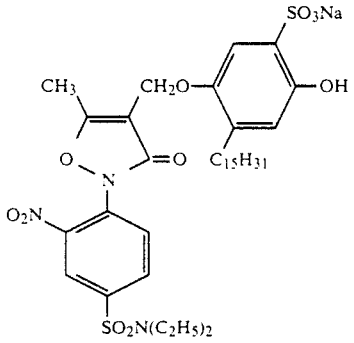

-continued
35
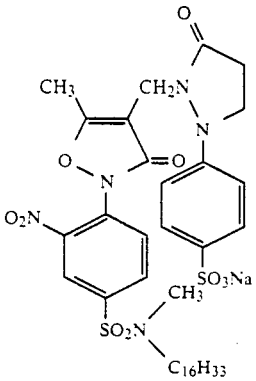
36
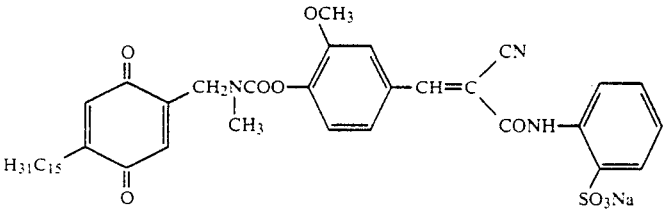
37
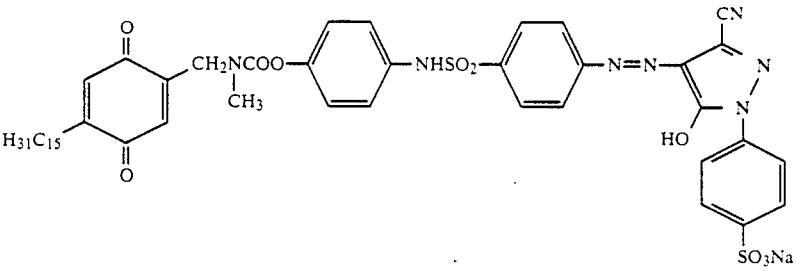
38
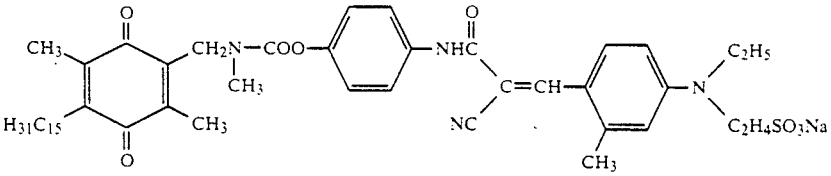
39
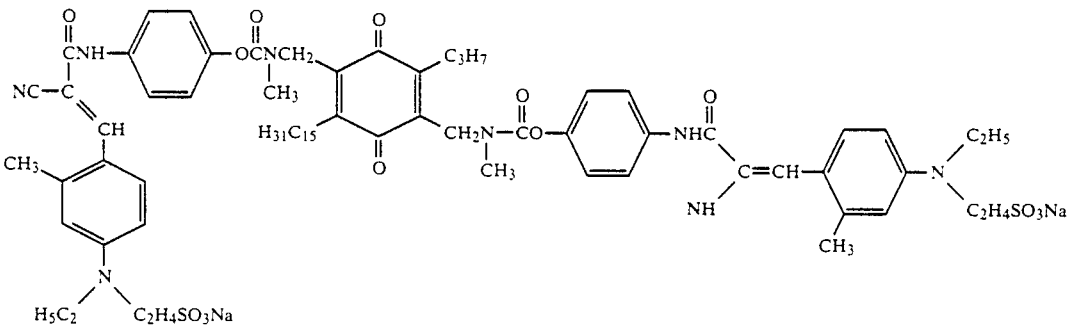
40
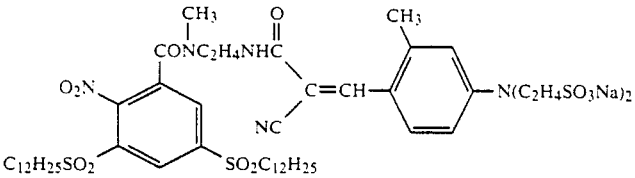

-continued
41
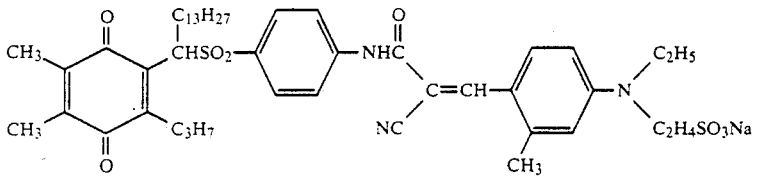
42
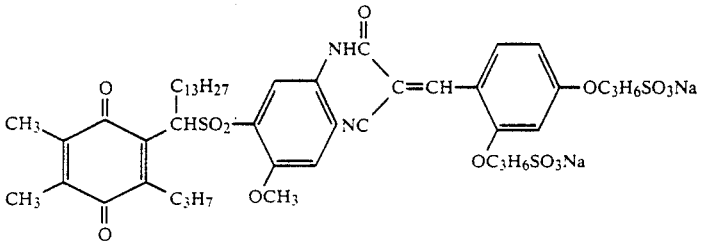
43
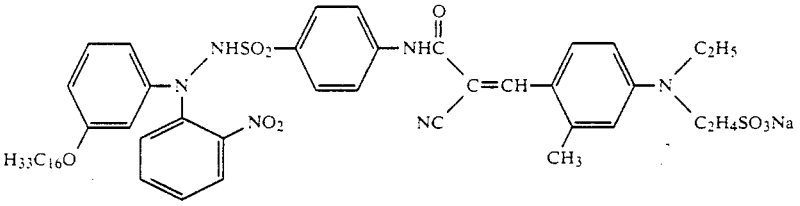
44
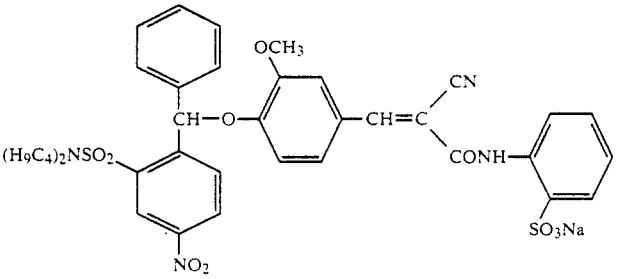
45
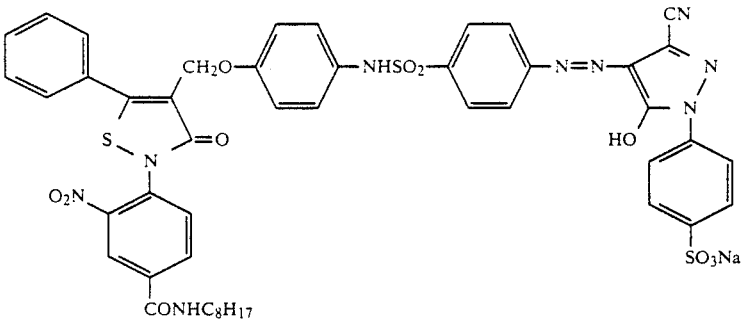
46
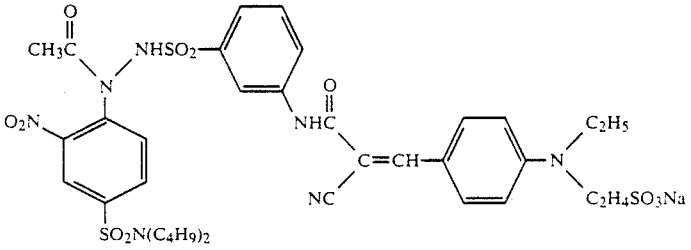

-continued

47

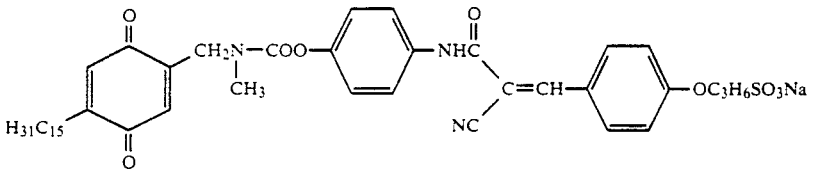

48

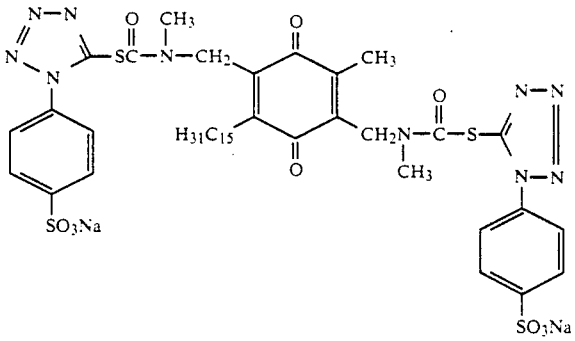

49

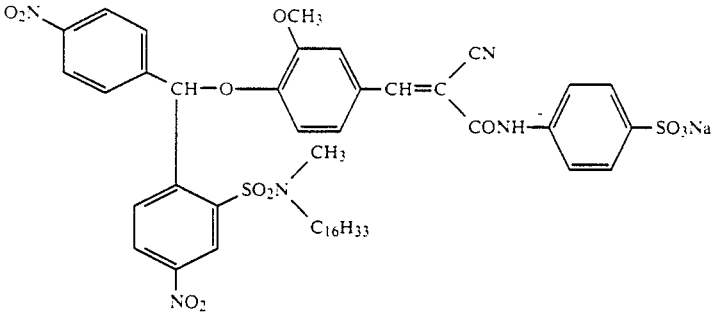

50

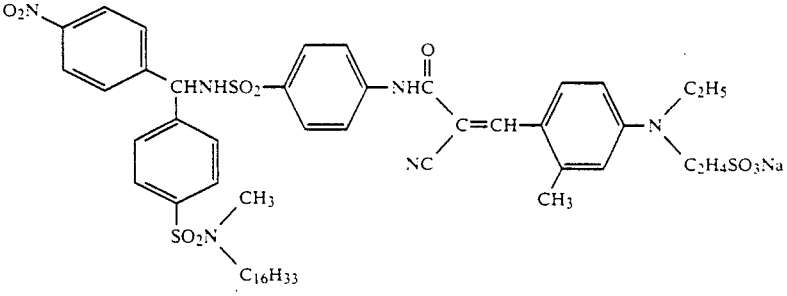

51

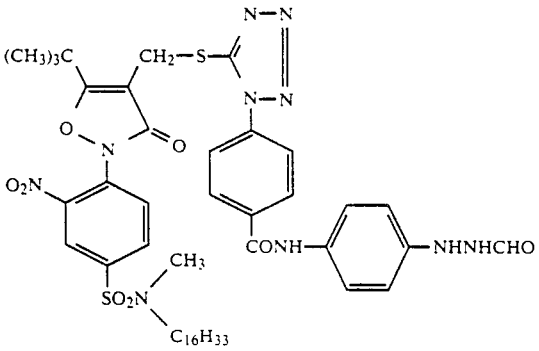

The compound of the present invention can be incorporated in either the light-sensitive layers or in any other constitutional layers (e.g., a protective layer, an interlayer, a filter layer, an anti-halation layer, an image-receiving layer), of the photographic material.

The compound of the present invention can be used in a broad range of amounts. The preferred amount varies, depending upon the kind of PUG employed. For example, when PUG is a diffusive dye, the compound is used in an amount of from 0.05 mmol/m$^2$ to 50 mmol/m$^2$, preferably form 0.1 mmol/m$^2$ to 5 mmol/m$^2$, depending upon the absorbancy index of the dye. When PUG is a development inhibitor, it is preferred that the compound is used in an amount of from $1\times10^{-7}$ mol to $1\times10^{-1}$ mol, and especially preferably from $1\times10^{-3}$ mol to $1\times10^{-2}$ mol, per mol of silver halide. When PUG is a development accelerator or a nucleating agent, the amount of the compound to be added is preferably the same as the said development inhibitor-containing compound. When PUG is a silver halide, it is preferred that the compound is used in an amount of from $1\times10^{-5}$ mol to $1\times10^{3}$ mol, and especially preferably from $1\times10^{-4}$ mol to $1\times10^{-1}$ mol, per mol of silver halide.

The compound of the present invention can release a photographically useful group or a precursor thereof, after having accepted an electron from a reducing substance. Accordingly, if a reducing substance is uniformly reacted with the compound of the present invention, it is possible to uniformly release a photographically useful group or a precursor thereof from the compound so that a photographically useful function can thereby uniformly be expressed. If the reducing substance is imagewise converted to the oxidation product thereof, it is possible to reverse-imagewise release a photographically useful group or a precursor thereof, so as to express the intended photographically useful function.

The reducing substance may be either an inorganic compound or an organic compound, but the oxidation potential thereof is preferably lower than the standard redox potential of silver ion/silver which is 0.80 V.

The amount used of the reducing agent is preferably from 0.1 to 10 mol, more preferably from 0.5 to 5 mol, per mol of the compound of the present invention.

The reducing substance can be used in a combination of two or more thereof. In particular, it is preferred to use a compound which is designated as an electron transfer agent (ETA) and a compound which is designated as an electron donator together for the purpose of adjusting the proportion of the release of a photographically useful group or of the expression of the usefulness thereof between the developed part and the non-developed part. As the electron donator, the compounds (S-1) to (S-45) described in European Patent Application No. 220,746A, pages 112 to 124 are usable.

As examples of compounds which can be used as the reducing substance in the present invention, there are inorganic reducing agents such as sodium sulfite, sodium hydrogensulfite, etc., as well as benzenesulfinic acids, hydroxylamines, hydrazines, hydrazides, boraneamine complexes, hydroquinones, aminophenols, catechols, p-phenylenediamines, 3-pyrazolidinones, hydroxytetronic acid, ascorbic acid, 4-amino-5-pyrazolones, etc. In addition, the reducing agents described in T. H. James, *The Theory of the Photographic Process*, 4th Ed., pages 291 to 334, can also be used Further, the reducing agent precursors described in Japanese Patent Application (OPI) Nos. 138736/81 and 40245/82 and U.S. Pat. No. 4,330,617, can also be used.

Examples of more preferred reducing agents are as follows:

3-Pyrazolidones and precursors thereof, for example, 1-phenyl-3-pyrazolidone, 1 phenyl-4,4-dimethyl-3-pyrazolidone, 4-hydroxymethyl-4-methyl-1-phenyl-3-pyrazolidone, 1-m-tolyl-3-pyrazolidone, 1-p-tolyl 3-pyrazolidone, 1-phenyl-4-methyl-3-pyrazolidone, 1-phenyl-5-methyl-3-pyrazolidone, 1-phenyl-4,4-bis-(hydroxymethyl) 3-pyrazolidone, 1,4-di-methyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone.

Hydroquinones and precursors thereof, for example, hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenyl, 2-methyl-4-benzoyloxyphenyl, 2-t-butyl-4-(4-chlorobenzoyloxy)phenyl.

Combinations of various kinds reducing agents, such as those described in U.S. Pat. No. 3,039,869, can also be used in the present invention.

As the reducing substance for use in the present invention, color developing agents are also usable, for example, p-phenylene series color developing agents, such as N,N-diethyl-3-methyl-p-phenylenediamine which are described in U.S. Pat. No. 3,531,286. Further usable reducing agents are the aminophenols described in U.S. Pat. No. 3,761,270. Among the aminophenol reducing agents which are especially preferred are 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc. In addition, *Research Disclosure*, Vol. 151, (RD No. 15108) and U.S. Pat. No. 4,021,240 mention 2,6-dichloro-4-substituted sulfonamidophenols and 2,6-dibromo-4-substituted sulfonamidophenols; and Japanese Patent Application (OPI) No. 116740/84 mentions p-(N,N-dialkylaminophenyl)sulfamine, etc. These compounds can be used as the reducing substance for the present invention. In addition to the above-mentioned phenol series reducing agents, naphthol series reducing agents, such as 4-amino-naphthol derivatives and 4-substituted sulfonamidonaphthol derivatives, are also usable. Further, other various common color developing agents can also be applied to the present invention. These are for example, the aminohydroxypyrazole derivatives described in U.S. Pat. No. 2,895,825, the aminopyrazoline derivatives described in U.S. Pat. No. 2,892,714 and the hydrazone derivatives described in *Research Disclosure* (June, 1980), pages 227 to 230 and pages 236 to 240 (RD No. 19412, RD No. 19415). These color developing agents can be used either singly or in the form of a combination of two or more thereof.

The reducing agent of the present invention can be incorporated into the hydrophilic colloid layer of the photographic light-sensitive material, preferably together with the functional compound of the present invention. Alternatively, the reducing agent can also be incorporated into an image-forming processing solution, and preferably into a developer or a pre-bath thereof. In the photographic light-sensitive material, the reducing agent is present, preferably under a neutral or acidic condition where the agent is inactive as a reducing substance. For the incorporation of the reducing agent, it is preferred that it is dispersed in a layer of the material by the same dispersion method as the functional compound of the present invention, and preferably the reducing agent and the functional compound are dispersed in the same layer. In this case, it is preferred that the reducing agent has a water-soluble group or may have an anion group under reaction condition. The water-soluble group-containing or anion group-containing reducing agent can also be dispersed by so-called oil dispersion, polymer dispersion or latex polymer dispersion.

The reducing agent to be incorporated into the photographic light-sensitive material is preferred to be inactive or weakly active as a reducing agent in the material, but may become strongly active as a reducing agent in the color development step after the material has been imagewise exposed. In particular, it is especially preferred that the reducing agent is such that it can be incorporated into the same layer, more preferably in the same fine grain dispersion, as that containing the functional compound of the present invention.

Preferred examples of the reducing agents for use in the present invention are as follows:

S-1

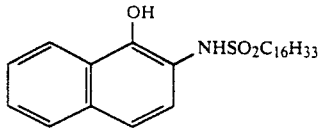

S-2

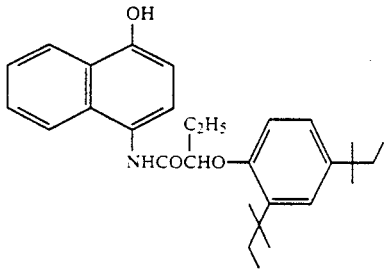

S-3

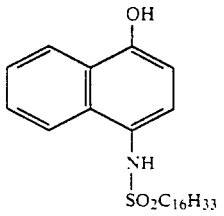

S-4

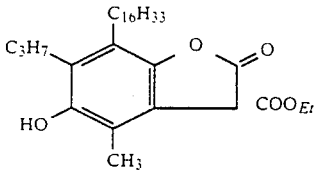

S-5

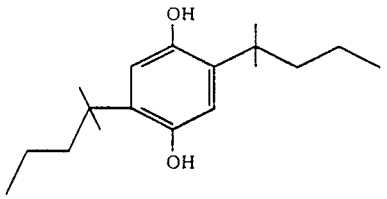

S-6

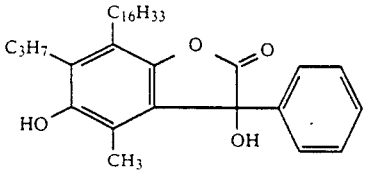

S-7

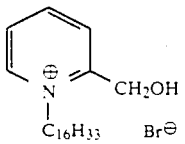

-continued
S-8
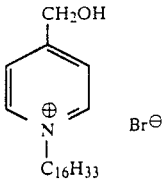
S-9
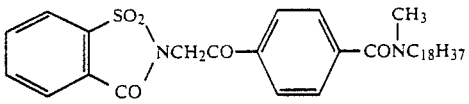
S-10
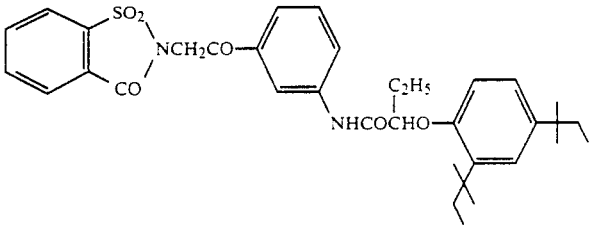
S-11
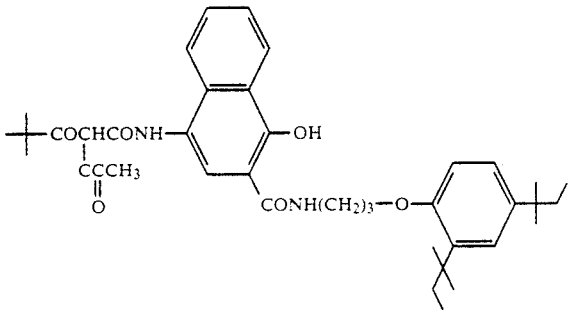
S-12
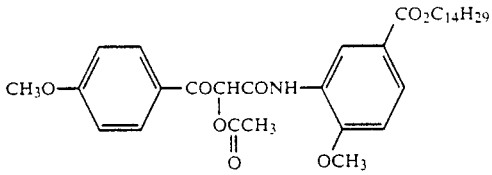
S-13
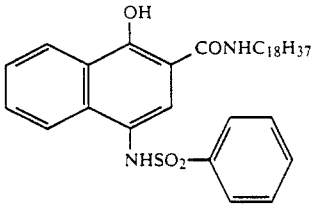
S-14
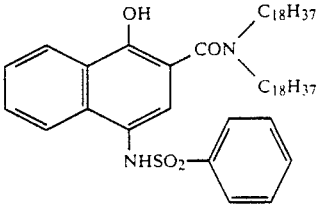

-continued
S-15
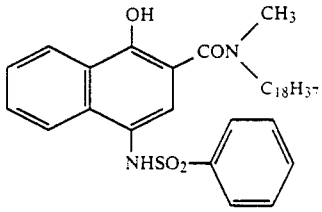
S-16
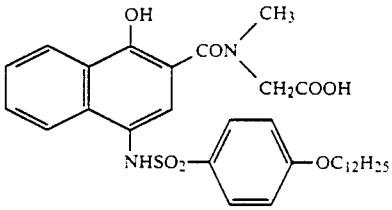
S-17
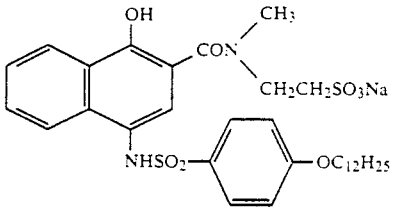
S-18
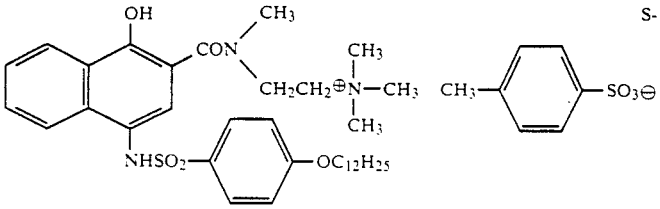
S-19
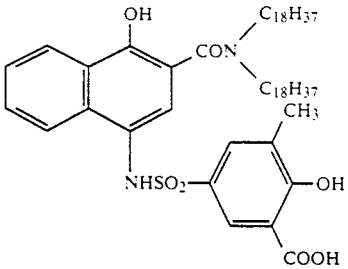
S-20
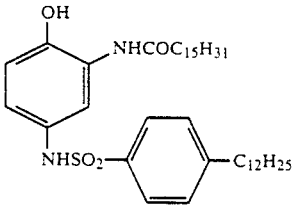
S-21
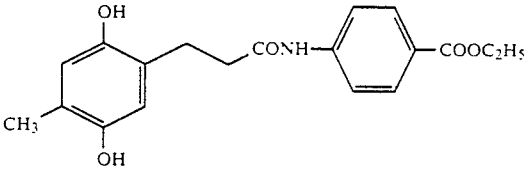

-continued
S-22
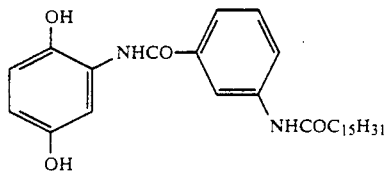
S-23
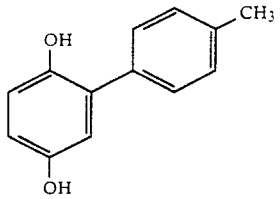
S-24
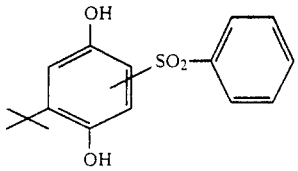
S-25
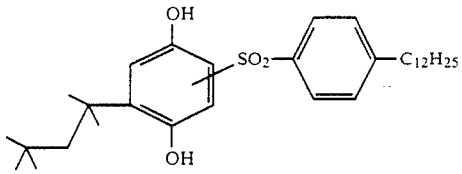
S-26
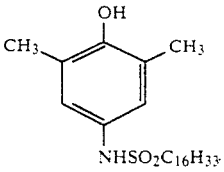
S-27
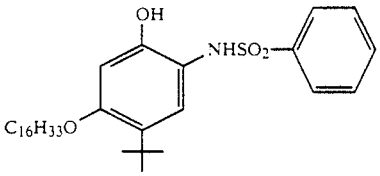
S-28
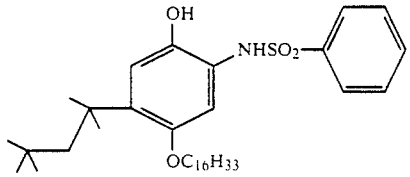
S-29
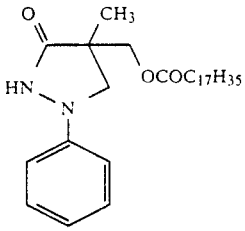

-continued
S-30
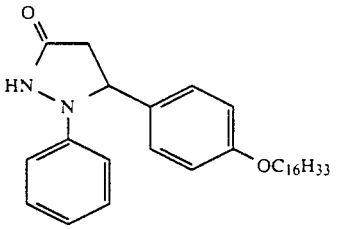
S-31
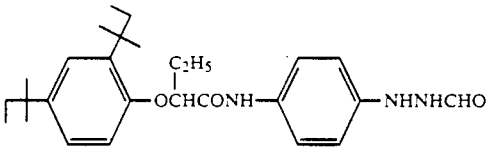
S-32
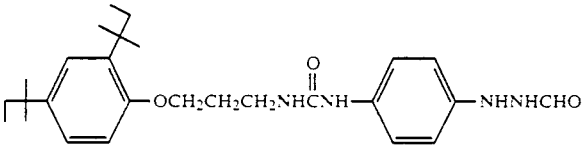
S-33
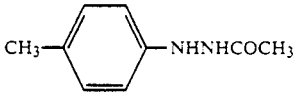
S-34
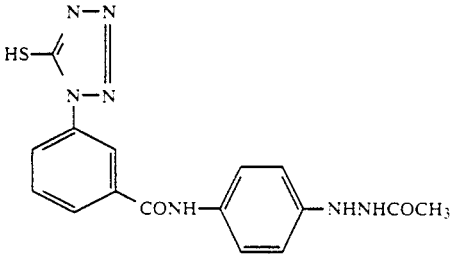
S-35
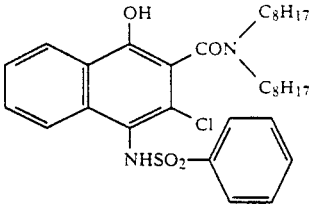
S-36
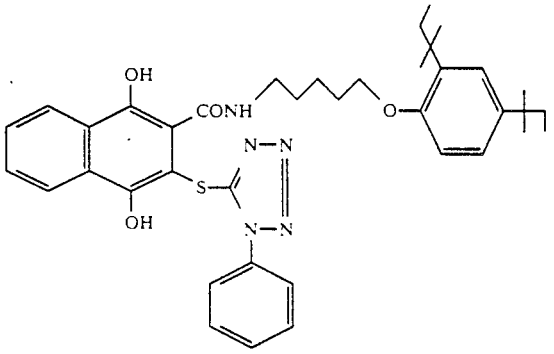

-continued
S-37
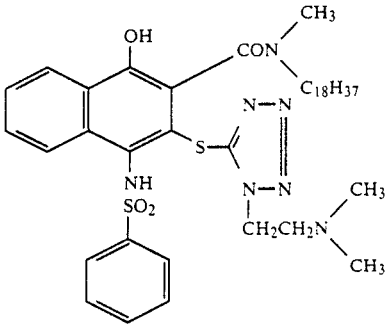
S-38
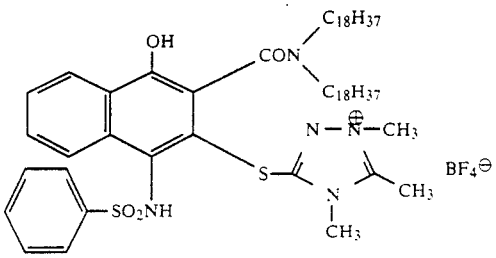
S-39
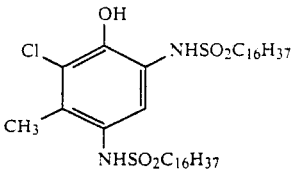
S-40
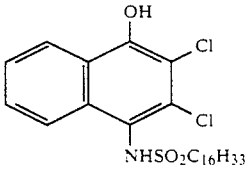
S-41
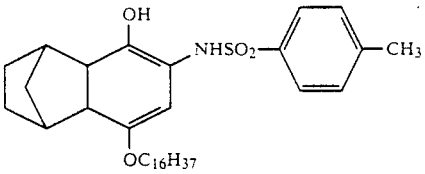
S-42
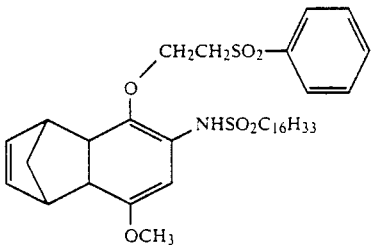
S-43
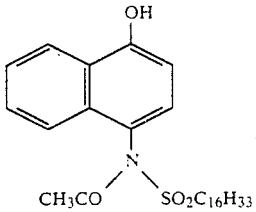

-continued

S-44

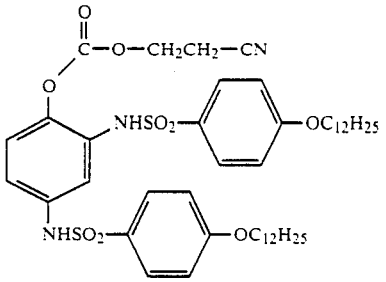

S-45

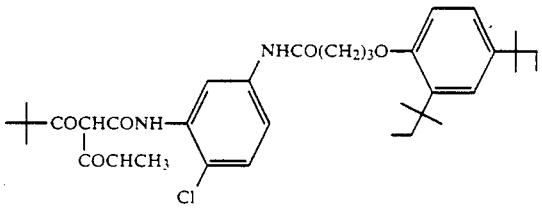

Especially preferred compounds are those of formula (IV) or (V):

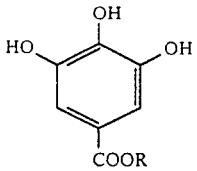

(IV)

in which R represents a linear or branched alkyl group having from 1 to 18 carbon atoms.

Specific examples of the alkyl gallates of the formula (IV) are as follows:

S-46: Methyl Gallate
S-47: Ethyl Gallate
S-48: N-propyl Gallate
S-49: Isopropyl Gallate
S-50: N-butyl Gallate
S-51: Isoamyl Gallate
S-52: D-amyl Gallate
S-53: N-hexyl Gallate
S 54: N-heptyl Gallate
S-55: N-octyl Gallate
S-56: N-nonyl Gallate
S-57: N-decyl Gallate
S-58: N-undecyl Gallate
S-59: N-dodecyl Gallate
S-60: N-tetradecyl Gallate
S-61: N-hexadecyl Gallate
S-62: N-octadecyl Gallate

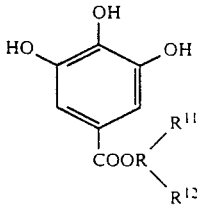

(V)

in which $R^{11}$ and $R^{12}$ each represent a hydrogen atom, a substituted or unsubstituted aliphatic group, a substituted or unsubstituted aromatic group or a substituted or unsubstituted heterocyclic group, or $R^{11}$ and $R^{12}$ may form a ring, provided that $R^{11}$ and $R^{12}$ must not be hydrogens at the same time.

The aliphatic group for $R^{11}$ and $R^{12}$ in formula (V) includes a linear or branched alkyl group, a linear or branched alkenyl group, a cycloalkyl group and a linear or branched alkynyl group.

The linear or branched alkyl group may have from 1 to 30 carbon atoms, preferably from 1 to 20 carbon atoms, and includes, for example, a methyl group, an ethyl group, a propyl group, an n-butyl group, a sec-butyl group, a t-butyl group, an n-hexyl group, a 2-ethylhexyl group, an n-octyl group a t-octyl group, an n-dodecyl group, an n-hexadecyl group, an n-octadecyl group, an isostearyl group, an eicosyl group, etc.

The linear or branched alkenyl group may have from 2 to 30 carbon atoms, preferably from 3 to 20 carbon atoms, and includes, for example, an allyl group, a butenyl group, a prenyl group, an octenyl group, a dodecenyl group, an oleyl group, etc.

The cycloalkyl group may be 3-membered to 12-membered, preferably 5-membered to 7-membered, and includes, for example, a cyclopropyl group, a cyclopentyl group, a cyclohexyl group, a cycloheptyl group, a cyclododecyl group, etc.

The linear or branched alkynyl group may have from 3 to 30 carbon atoms, preferably from 3 to 22 carbon atoms, and includes, for example, a propargyl group, a butynyl group, etc.

The aromatic group for $R^{11}$ and $R^{12}$ includes, for example, a phenyl group and a naphthyl group.

The heterocyclic group for $R^{11}$ and $R^{12}$ includes, for example, a thiazolyl group, an oxazolyl group, an imidazolyl group, a furyl group, a thienyl group, a tetrahydrofuryl group, a piperidyl group, a thiadiazolyl group, an oxadiazolyl group, a benzothiazolyl group, a benzoxazolyl group, a benzimidazolyl group, etc.

$R^{11}$ and $R^{12}$ may form a ring, for example, a 3-membered to 12-membered or, preferably a 5-membered to 12-membered one. For example, an ethylene, tetramethylene, pentamethylene, hexamethylene or dodecamethylene group, etc., may be used.

The above-noted groups may have substituent(s). As the substituents, the following may be used: an alkoxy group, an aryloxy group, a hydroxyl group, an alkoxycarbonyl group, an aryloxycarbonyl group, a halogen atom, a carboxyl group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, an acyloxy group, an acylamino group, etc.

Specific examples of the above-noted compounds are shown below.

S-63

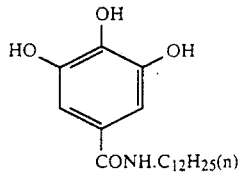

S-64

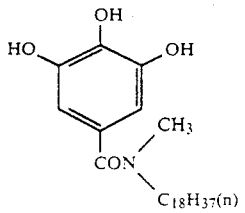

S-65

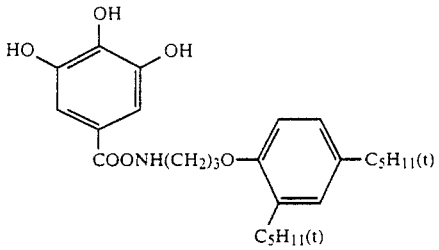

S-66

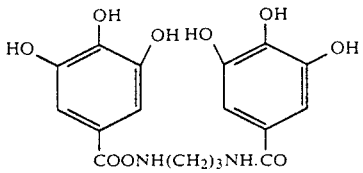

Especially preferred compounds are those of formula (VI):

(VI)

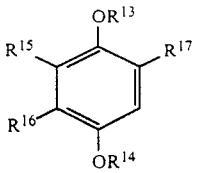

in which $R^{13}$ and $R^{14}$ may be same or different and each represents a hydrogen atom or a group capable of being hydrolyzed with an alkali; $R^{15}$, $R^{16}$ and $R^{17}$ each represent a hydrogen atom, a sulfo group, a carboxyl group, a sulfoalkyl group, a carboxyalkyl group or an alkyl group, provided that at least one of $R^{15}$, $R^{16}$ and $R^{17}$ is a group selected from a sulfo group, a carboxyl group, a sulfoalkyl group and a carboxyalkyl group.

In the above-mentioned formula (VI), When $R^{13}$ and/or $R^{14}$ is(are) a group capable of being hydrolyzed with an alkali, examples of such group include an actyl group, a trichloroacetyl group, an ethoxycarbonyl group, a benzoyl group, etc. As examples of the groups for $R^{15}$, $R^{16}$ and $R^{17}$, the sulfoalkyl group includes a 1,1-dimethyl-2-sulfoethyl group, the carboxyalkyl group includes a 5-carboxypentyl group, the alkyl group includes a methyl group, an ethyl group, a t-octyl group, an n-octyl group, a sec-dodecyl group, an n pentadecyl group, a secoctadecyl group, etc.

In formula (IV), $R^{13}$ and $R^{14}$ are preferably hydrogen atoms, and $R^{15}$, $R^{16}$ and $R^{17}$ are preferably selected from a sulfo group and an alkyl group. More preferably, $R^{17}$ is a sulfo group or a carboxyl group, and one of $R^{15}$ and $R^{16}$ is an alkyl group and the other is a hydrogen atom.

Most preferably, $R^{15}$ is a hydrogen atom, $R^{16}$ is an alkyl group, and $R^{17}$ is a sulfo group.

The compounds of formula (VI) can be produced by the methods described in British Patent 891,158 and U.S. Pat. No. 2,701,197, or any like methods.

Specific examples of the compounds are shown below.

S-67

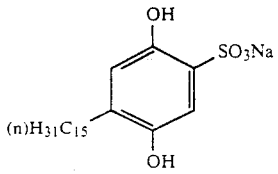

S-68

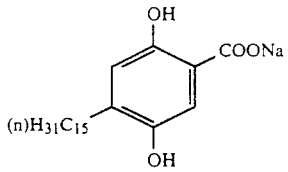

S-69

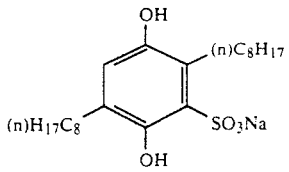

S-70

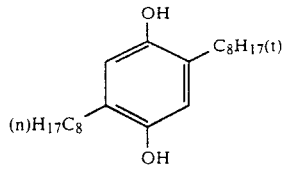

S-71

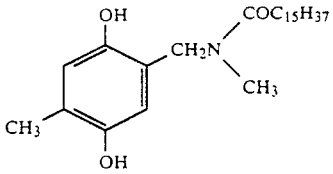

S-72

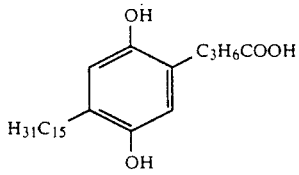

In order to accelerate the cleavage reaction during the processing of the functional compound of the present invention, a means of elevating the pH value in the film to be processed may be employed along with the use of the above-mentioned reducing agent. For instance, a hardly soluble metal compound of a transition metal or an alkaline earth metal may be incorporated into the photographic light-sensitive material, especially into the image-receiving layer thereof, as so described in European Patent Application No. 210660A. On the other hand, a means of donating a complex-forming compound (for example, a metal ion complex-forming salt of an organic salt and an organic base), to the metal compound from the processing solution can also be employed. The hardly soluble metal compound includes, for example, calcium carbonate, zinc carbonate, zinc hydroxide, calcium silicate, etc., which can be produced by the method described in Japanese Patent Application (OPI) Nos. 174830/84, 102733/78, etc. The complex-forming compound includes, for example, picolinic acid, pyridine-dicarboxylic acid, EDTA, CyDTA (1,2-cyclohexanediamine tetraacetic acid), etc. The organic base includes, for example, guanidines, amidines, tetraammonium hydroxides, etc.

Although the functional compound of the present invention functions as a surfactant by itself, this can be used together with any other anionic or nonionic surfactant. In particular, not only low boiling point organic solvents, but also high boiling point organic solvents such as phthalic acid esters, phosphoric acid or phosphonic acid esters, benzoic acid esters, aliphatic carboxylic acid esters, aniline derivatives, etc., can be used as an auxiliary aid for the functional compounds of the present invention, or the said solvents can be used together with a fine grain dispersion of the functional compound. As surfactants, especially as anionic surfactants, the compounds described in Japanese Patent Publication Nos. 31688/84 and 36415/81 are preferred. Preferred examples of the compounds are those of the following formulae:

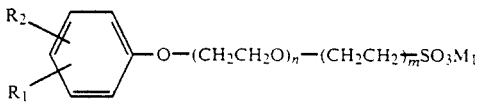

(VII)

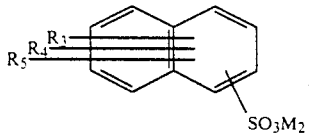

(VIII)

(IX) Surfactant copolymers having the following repeating unit:

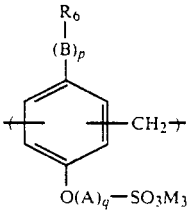

In these formulae, $R_1$ and $R_2$ each represent a hydrogen atom or a $C_1$ to $C_{18}$ alkyl group;

$R_3$, $R_4$ and $R_5$ each represent a hydrogen atom or a $C_1$ to $C_{12}$ alkyl group; provided that the sum of the carbon atoms of $R_3$, $R_4$ and $R_5$ is 18 or less;

$R_6$ represents a $C_4$ to $C_{22}$ aliphatic hydrocarbon group;

$M_1$, $M_2$ and $M_3$ each represent a cation radical for forming a salt with a sulfonic acid;

A represents divalent $C_1$ to $C_{50}$ aliphatic group;

B represents —O— or —NH—;

n represents an integer of from 1 to 20; and m, p and q each represent an integer of 0 or 1.

Specific examples of the compounds are as follows:

W-1

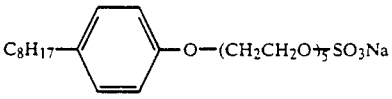

W-2

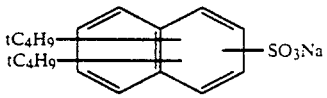

W-3

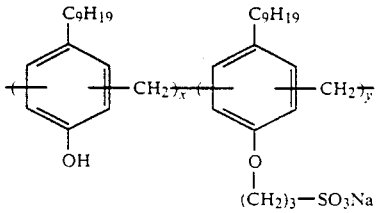

(x:y = 5:5, x + y ≃ 6)

W-4

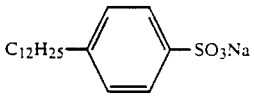

Further, the compounds described in Japanese Patent Publication Nos. 36415/81 and 31688/84 can also be used.

The silver halide emulsion for use in the present invention can be produced, in general, by blending a water-soluble silver salt (e.g., silver nitrate) solution and water-soluble halogen (e.g., potassium bromide) solution(s) in the presence of a water soluble polymer (e.g., gelatin) solution. The silver halide which can be used includes, for example, silver chloride, silver bromide, as well as mixed silver halides, such as silver chlorobromide, silver iodobromide, silver chloroiodobromide, etc. The mean grain size (i.e., the diameter of the grain when the grain is spherical or resembles spherical, or the mean value based on the projected area using the edge length as the size when the grain is a cubic grain) of the silver halide grains for use in the present invention, is preferably 2 μ or less, and more preferably 0.4 μ or less. The grain size distribution may be either narrow or broad.

The crystal form of the silver halide grains may be a cubic octahedral system or a mixed crystal form thereof, or the grains may be tabular, as described in Japanese Patent Application (OPI) Nos. 127921/83, 113926/83, etc.

Two or more silver halide photographic emulsions which have been prepared separately can be blended. Regarding the crystal structure, the silver halide grains may have a uniform structure throughout the whole grain, or may have a layered structure comprising different inner and outer compositions, or the grains may be so-called conversion type grains, for example those described in British Patent 635,841 and U.S. Pat. No. 3,622,318. The grains may be either surface latent image type grains which form a latent image mainly on the surface of the grains or internal latent image type grains which form a latent image in the inside of the grains. In the latter case, a positive image can directly be formed in the presence of a nucleating agent or a photo-fogging agent.

The silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsion can be used in the form of a so-called primitive emulsion which is not chemically ripened, but in general, chemically ripened solutions are used.

For the chemical sensitization of the silver halide emulsions for use in the present invention, a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidinesulfinic acid, sulane compounds, etc.), a noble metal sensitization method using a noble metal compound (e.g., gold complex salts and complex salts of metals belonging to group VIII of the Periodic Table, such as platinum, iridium, palladium, etc.) can be used individually or as a combination thereof.

As the binder or protective colloid which can be used for the emulsion layers, interlayers, etc., of the photographic materials of the present invention or as the hydrophilic colloid which can be used for dispersing the functional compound of the present invention or the reducing agent for the compound, gelatin is advantageously used, but other hydrophilic colloids can also be used.

For example, other usable binders include proteins, such as gelatin derivatives, graft polymers of gelatin and other polymers, albumin, casein, etc.; cellulose derivatives, such as hydroxyethyl cellulose, carboxymethyl cellulose, cellulose sulfates, etc.; saccharose derivative, such as sodium aliginate, dextrane, starch derivative, etc.; and various synthetic hydrophilic homopolymers or copolymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or enzyme-processed gelatin can be used. Also, the hydrolyzed products or enzyme-decomposed products of gelatin can also be used.

The photographic materials of the present invention can contain an inorganic or organic hardening agent in the photographic emulsion layer(s) and other hydrophilic colloid layer(s). For example, chromium salts (e.g., chromium alumn, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), N-carbamoylpyridinium salts (e.g., (1-morpholinocarbonyl-3-pyridinio)methanesulfonate, etc.), haloamidinium salts (e.g., 1-(1-chloro-1-pyridinomethylene)pyrolidinium, 2-naphthanesulfonate, etc.), etc., can be used singly or in the form of a combination thereof.

Of these compounds, active vinyl compounds and active halogen compounds can preferably be used.

The photographic materials of the present invention may further contain in the photographic emulsion layer(s) or in other hydrophilic colloid layer(s), various kinds of surfactants for various purposes such as coating aids, static charge prevention, improvement of slide property, emulsification and dispersion, surface-blocking prevention, improvement of photographic characteristics (for example, development acceleration, contrast elevation, sensitivity enhancement), etc.

The photographic emulsion for use in the present invention can be spectrally sensitized with methine dyes, etc. Dyes which can be used for this purpose include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Various nuclei which are usually utilized for cyanine dyes as basic heterocyclic nuclei may be used for these dyes. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei; and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes the following can be applied, 5-membered or 6-membered heterocyclic nuclei, such as pyrazolin-5-one nuclei, thiahydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure. The above-described sensitizing dyes can be used singly or as a combination thereof. A combination of sensitizing dyes is frequently used for the purpose of super color sensitization.

The photographic materials of the present invention can further contain in the photographic emulsion layer(s), for example, polyoxyalkylene oxides or ether, ester or amine derivative thereof, thioether compounds, thiomorpholines, quaternary ammonium salt compounds, urethane derivatives, urea derivatives, imidazole derivatives, 3-pyrazolidones, etc., for the purpose of elevation of sensitivity, enhancement of contrast or acceleration of developability.

The photographic materials of the present invention can further contain a dispersion of a water-insoluble or hardly soluble synthetic polymer in the photographic emulsion layer(s) and other hydrophilic colloid layer(s), for the purpose of improving the dimension stability of the material, etc. For example, polymers formed from a single monomer of an alkyl (meth)acrylate, a glycidyl (meth)acrylate, a styrene, etc., or from a combination of these monomers or polymers formed from a combination of the said monomers and acrylic acid, methacrylic acid, etc., can be used for this purpose.

The photographic materials of the present invention can contain a water-soluble dye in the hydrophilic colloid layer(s) thereof, as a filter dye of for the purpose of anti-irradiation or for any other various purposes. These dyes include oxonole dyes, hemioxonole dyes, styryl dyes, merocyanine dyes, cyanine dyes and azo dyes. Most preferred are the oxonole dyes, hemioxonole dyes and merocyanine dyes.

The photographic emulsion for use in the present invention can contain various kinds of compounds other than the functional compound of the present invention, for the purpose of preventing fog during manufacture, storage or photographic processing of the photographic materials or for the purpose of stabilizing the photographic characteristic of the materials. For example, various kinds of compounds can be used for these purposes, which are known as an anti-foggant or stabilizer and which include, for example, azoles, such as benzothiazolium salts, nitroimidazoles, nitrobenzimidazoles, chlorobenzimidazoles, bromobenzimidazoles, nitroindazoles, benzotriazoles, aminotriazoles, etc.; mercapto compounds, such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines, etc.; thioketo compounds, such as oxazolinethione, etc.; azaindenes, such as triazaindenes, pentazaindenes, etc.; benzenethiosulfonic acid, benzenesulfinic acid, benzenesulfonic acid amide, etc.

The photographic materials of the present invention can contain color image-forming couplers, or that is, compounds capable of coloring by oxidation coupling with an aromatic primary amine developing agent (such as phenylene diamine derivatives, aminophenols, etc.) in a color development process. The couplers to be incorporated into the photographic materials of the present invention are preferably non-diffusible due to the inclusion of a ballast group or being polymerized. The couplers may be either 4-equivalent or 2-equivalent to silver ions. Further, the photographic materials of the present invention can also contain colored couplers having a color-correcting effect or so-called DIR couplers capable of releasing a development inhibitor with development. These may also contain colorless DIR coupling compounds which form a colorless product by coupling reaction and which can release a development inhibitor.

For example, there may be employed 5-pyrazolone couplers, pyrazolobenzimidazole couplers, cyanoacetyl chroman couplers, non-cyclic acylacetonitrile couplers, pyrazolotriazole couplers, etc., as a magenta coupler; acylacetamide couplers (e.g., benzoylacetanilides, pivaloylacetanilides, etc.), etc., as a yellow coupler; and naphthol couplers, phenol couplers, etc., as a cyan coupler. These couplers can be used in the photographic materials of the present invention.

Two or more of the above-described couplers can be incorporated together in the same layer so as to meet the necessary characteristics required for the photographic materials, or the same compound can of course be added to two or more different layers without difficulty.

For introduction of the couplers into the silver halide emulsion layers of the materials of the present invention, any conventional method, for example the method described in U.S. Pat. No. 2,322,027, can be utilized.

The photographic materials of the present invention can contain a known anti-fading agent. Examples of known anti-fading agents include hydroquinone derivatives, gallic acid derivatives, p-alkoxyphenols, p-hydroxyphenol derivatives, bisphenols, etc.

The photographic materials of the present invention can further contain various kinds of additives in accordance with the objects thereof, other than the above-mentioned additives.

The additives which can be used for the materials of the present invention are described in detail in *Research Disclosure*, Item 17643 (Dec. 1978) and *Research Disclosure*., Item 18716 (Nov. 1979). The relevant parts thereof are summarized in the following Table.

| No. | Additives | RD 17643 | RD 18716 |
|---|---|---|---|
| 1. | Chemical Sensitizer | p. 23 | p. 648, right column |
| 2. | Sensitivity Enhancer | | p. 648, right column |
| 3. | Spectral Sensitizer<br>Super Color Sensitizer | pp. 23 to 24 | from p. 648, right column to p. 649, right column |
| 4. | Brightening Agent | p. 24 | |
| 5. | Anti-foggant<br>Stabilizer | pp. 24 to 25 | p. 648, right column |
| 6. | Light Absorbent<br>Filter Dye<br>UV Absorbent | pp. 25 to 26 | from p. 649, right column to p. 650, left column |
| 7. | Stain Inhibitor | p. 25, right column<br>right column | p. 650, from left to right column |
| 8. | Color Image Stabilizer | p. 25 | |
| 9. | Hardener | p. 26 | p. 650, left column |
| 10. | Binder | p. 26 | p. 650, left column |
| 11. | Plasticizer,<br>Lubricant | p. 27 | p. 650, right column |
| 12. | Coating Aid<br>Surfactant | pp. 26 to 27 | p. 650, right column |
| 13. | Antistatic Agent | p. 27 | p. 650, right column |

For photographic processing of the materials of the present invention any known methods may be employed, and any known processing solution can be used therefor. The processing temperature can be selected, in general, from the range of between 18° C. and 50° C., but the temperature may be lower than 18° C. or may be higher than 50° C., as the case may be. In accordance with the object of the invention, a development process for forming silver images (black-and-white development process) or a color photographic process for forming color images may be applied to the photographic materials of the present invention.

For the black-and-white developer can be used any known developing agents, for example, dihydroxybenzenes (e.g., hydroquinone), 3-pyrazolidones (e.g., 1-phenyl-3-pyrazolidone), aminophenols (e.g., N-methyl-p-aminophenol), etc., and these agents can be used singly or in combination thereof.

The color developer is, in general, an alkaline aqueous solution containing a color developing agent. As the color developing agent can be used any known primary aromatic amine developing agent, for example, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

Further, the compounds described in L. F. A Mason, *Photographic Processing Chemistry* (published by Focal Press, 1966), pages 226–229, U.S. Pat. Nos. 2,193,015, 2,592,364, Japanese Patent Application (OPI) No. 64933/73, etc., can also be used.

The developer may further contain, in addition to the above-mentioned regent, a pH buffer such as alkali metal sulfites, carbonates, borates or phosphates, and/or a development inhibitor or anti-foggant such as bromides, iodides and organic anti-foggants other than the compounds of the present invention. In addition, the developer may also contain, if desired, a water softener, a preservative such as hydroxylamine, an organic solvent such as benzyl alcohol or diethylene glycol, a development accelerator such as polyethylene glycol, quaternary ammonium salts or amines, a dye-forming coupler, a competing coupler, a foggant such as sodium boronhydride, an auxiliary developing agent such as 1-phenyl-3-pyrazolidone, a tackifier, a polycarboxylic acid series chelating agent such as the compounds described in U.S. Pat. No. 4,083,723, an anti-oxidant such as the compounds described in West German Patent Application (OLS) No. 2,622,950, etc.

Generally, when the photographic materials are processed by a color photographic process, the materials are, after being color-developed, bleached. The bleaching process can be carried out simultaneously with fixation or separately therefrom. As the bleaching solution, for example, compounds of polyvalent metals such as iron(III), cobalt(III), chromium(VI), copper(II), etc., peracids, quinones, nitroso compounds, etc. can be used. For example, ferricyanides, bichromates, organic complexes with iron(III) or cobalt(III), such as complexes with aminopolycarboxylic acids (e.g., ethylenediaminetetraacetic acid, nitrilo-triacetic acid, 1,3-diamino-2-propanol-tetraacetic acid, etc.) or with organic acids (e.g., citric acid, tartaric acid, malic acid, etc.); persulfates, permaganates; nitrosophenol, etc., can be used. Among them, potassium ferricyanine, sodium ethylenediamine-tetraacetic acid iron(III) and ammonium ethylenediamine-tetraacetic acid iron(III) are especially useful. Ethylenediamine-tetraacetic acid iron(III) complexes are usable either in an independent bleaching solution or in a combined bleach-fixing mono-bath solution.

To the bleaching or bleach-fixing solution can be added the bleaching accelerator described in U.S. Pat. Nos. 3,042,520, 3,241,966, Japanese Patent Publication Nos. 8506/70, 8836/70, etc., the thiol compound described in Japanese Patent Application (OPI) No. 65732/78, as well as other various kinds of additives.

The rinsing step can be carried out in one bath, but this is carried out in accordance with a multi-stage countercurrent rinsing system having two or more baths in many cases. The amount of the water to be used in the rinsing step can freely be determined in accordance with the kind of the photographic materials to be processed and the object thereof, but, for example, this can also be calculated out in accordance with the method described in *Journal of Motion Picture and Television Engineering*, Vol. 64, pages 248 to 253 (May, 1955), "Water Flow Rates in Immersion-Washing of Motion Picture Film", (by S. R. Goldwasser).

When the amount of the water to be used in the rinsing step is economized, propagation of bacteria and fungi would become problematic. As a countermeasure against this problem, the use of a rinsing water in which the amount of calcium and magnesium has been reduced, as described in Japanese Patent Application No. 131632/86, as well as addition of a bactericide or fungicide, for example, the compounds described in *J. Antibact. Antifung. Agents*, Vol. 11, No. 5, pages 207 to 223 (1983) and H. Horiguchi, *Bactericidal and Fungicidal Chemistry*, can be employed. Further, a chelating agent such as ethylenediamine-tetraacetic acid, diethylenetriaminepentaacetic acid, etc., can also be added to the rinsing water as a water softener.

When the amount of the rinsing water is to be economized and reduced, this may be, in general, from 100 to 2,000 ml per $m^2$ of the photographic material to be processed, but preferably, this may be 200 to 1,000 ml per $m^2$ of the material, in view of both the color image stability and the water economization effect.

The pH value in the rinsing step is generally within the range of from 5 to 9.

The photographic materials of the present invention can be advantageously used also in a color image forming method where a diffusive dye is imagewise formed or released and diffused and then fixed.

The said color image forming method includes various systems, for example, a color diffusion transfer system where a photographic material is developed with a developer at a temperature near room temperature (for example, as described in Belgian Patent 757,959) and a heat development system where a photographic material is heat-developed substantially in the absence of water (for example, as described in European Patent 76492A2, Japanese Patent Application (OPI) Nos. 79247/83, 218443/84 and 238056/86), and the photographic materials of the present invention can be used in anyone of the said systems.

As a dye-forming substance which can be used in the above-mentioned color image forming method, there are the compounds of the above-mentioned formula (I) where PUG is an image-forming dye, but the compounds represented by formula (X) can also be used.

$$Dy-Y \qquad (X)$$

in which Dy represents a dye part or a precursor part thereof; and Y represents a substrate having a function of varying the diffusibility of the dye-forming substance of formula (X), as a result of development.

For the substrate Y, the "function of varying the diffusibility of the dye-forming substance" means that (1) the dye-forming substance of formula (X) is naturally non-diffusible and this is varied to be diffusible, or a diffusible dye is released, or (2) the dye-forming substance of formula (X), which is naturally diffusible, is converted to be non-diffusible. The variation depends upon the property of the substrate Y (that is, it may be caused by the oxidation of Y or by the reduction of Y).

As examples of "varying the diffusibility of the dye-forming substance" by oxidation of Y, these may be used so-called dye-releasing redox substrates, for example, p-sulfonamidonaphthols (including p-sulfonamidophenols, for example, the compounds described in Japanese Patent Application (OPI) Nos. 33826/73, 50736/78 and European Patent 76,492), o-sulfonamidophenols (including o-sulfonamidonaphthols, for example, the compounds described in Japanese Patent Application (OPI) Nos. 113624/76, 12642/81, 16130/81, 16131/81, 4043/82, 650/82, U.S. Pat. No. 4,053,312 and European Patent 76,492), hydroxysulfonamido-heterocyclic compounds (for example, the compounds described in Japanese Patent Application (OPI) No. 104343/76 and European Patent 76,492), 3-sulfonamidoindoles (for example, the compounds described in Japanese Patent Application (OPI) Nos. 104343/76, 46730/78, 130122/79, 85055/82 and European Patent 76,492), α-sulfonamidoketones (for example, the compounds described in Japanese Patent Application (OPI) Nos. 3819/78, 48534/79 and European Patent 76,492), etc.

As other examples, there may be used intramolecular assist-type substrates in which Y may release a dye by intramolecular nucleophilic attack after the oxidation thereof, for example, the compounds described in Japanese Patent Application (OPI) No. 20735/82 and Japanese Patent Application No. 177148/82.

As still other examples, there may be employed substrates which can release a dye by intramolecular ring-closing reaction under a basic condition but may not substantially release any dye when Y has been oxidized, for example, the compounds described in Japanese Patent Application (OPI) No. 63618/76. As a modified type of the substrates, there may also be used substrates which may release a dye by intramolecular rearrangement of the isoxazolone ring therein by the action of a nucleophilic reagent, and these are also useful. For example, Japanese Patent Application (OPI) Nos. 111628/74 and 4819/77 mention specific examples of these types of substrates.

As further examples, there may be used substrates which can release a dye part by dissociation of the acid proton under a basic condition, but cannot substantially release any dye after Y has been oxidized, for example, the compounds described in Japanese Patent Application (OPI) No 69033/78 and 130927/79.

Further compounds which may be reacted with a silver halide or an organic silver salt by redox reaction under the condition of a high temperature with the result that the mobility of the compound containing the dye part is thereby varied can also be used. Examples of these compounds are described in Japanese Patent Application (OPI) No. 165054/84.

Dye-forming substances which can release a mobile dye upon reaction with the silver ion in the photographic material are described in Japanese Patent Application (OPI) No. 180548/84, and these are also usable in the present invention.

In the system of the photographic materials of the present invention, the image-receiving element and the light-sensitive element can be provided on different supports, or can be combined in the form of a film unit.

As one typical system of a film unit, the said image-receiving element and light-sensitive element are laminated on one transparent support in layer. After completion of a transferred image, it is unnecessary for the light-sensitive element to be released from the image-receiving element. More precisely, the image-receiving element comprises at least one mordant layer, and the light-sensitive element preferably is comprised of a combination of a blue-sensitive emulsion layer, a green-sensitive emulsion layer and a red-sensitive emulsion layer, a combination of a green-sensitive emulsion layer, a red-sensitive emulsion layer and an infrared-sensitive emulsion layer, or a combination of a blue-sensitive emulsion layer, a red sensitive emulsion layer and an infrared-sensitive emulsion layer, in which a yellow dye-forming substance, a magenta dye-forming substance and a cyan dye-forming substance are combined with the said respective layers. (The "infrared-sensitive emulsion layer" means an emulsion layer having a light-sensitivity to light of 700 nm or more, especially 740 nm or more.) In the noted layer constitution, a white reflective layer containing a solid pigment such as titanium oxide or the like, is provided between the said mordant layer and the light-sensitive layer or the dye-forming substance-containing layer, so as to be able to see the transferred image through the transparent support. In order to conduct the development process in a dark place, a light-shielding layer can further be provided between the white-reflective layer and the light-sensitive layer. In addition, a peeling layer can be provided in a pertinent position in the layer constitution so as to release the whole or a part of the light-sensitive element from the image-receiving element, if desired. (Such an embodiment is described, for example, in Japanese Patent Application (OPI) No. 67840/81 and Canadian Patent 674,082.)

As another embodiment in which it is unnecessary for the two elements to be released from each other, the above-noted light-sensitive element, white reflective layer and image-receiving layer are laminated on one transparent support in this order. As still another embodiment, the image-receiving element, white-reflective layer, peeling layer and light-sensitive element are laminated on the same support and the light sensitive element is intentionally released from the image-receiving element. This type of embodiment is described in U.S. Pat. No. 3,730,718.

On the other hand, the light-sensitive element and the image-receiving element can be formed on the two different supports separately. There are two typical embodiments for this type of film unit, in which one is a releasing type and the other is a non-releasing type, which will be explained in detail. As a preferred embodiment of the releasing type film unit, a light-reflective layer is formed on the back surface of a support, and at least one image receiving layer is formed on the front surface thereof. On the other hand, the light-receiving element is formed on a light-shielding layer on a support. The unit of this type is so designed that the light-sensitive layer-coated surface is not facing the mordant layer-coated surface prior to exposure, but light-sensitive layer coated surface can be returned back, to be attached to the image-receiving layer-coated surface after exposure (for example, during the development process). After completion of the trasferred image in the mordant layer, the light-sensitive element is rapidly released from the image-receiving element.

As a preferred embodiment of the other non-releasing type film unit, at least one mordant layer is formed on a transparent support, and a light-sensitive element is formed on a transparent or a light-shielding layer on a support, and the light-sensitive layer-coated surface is attached face-to-face to the mordant layer-coated surface.

The above-mentioned embodiments can be applied to both a color diffusion transfer system and heat-development system. For the former system, it is especially preferred that the above-mentioned combination of the light-sensitive element and the image-receiving element further contains a container element, which contains an alkaline processing solution and which can be broken under pressure (i.e., a processing element). In particular, in the case of the non-releasing type film unit where the image-receiving element and the light-sensitive element are laminated on one support, it is preferred that the said processing element is disposed between the light-sensitive element and the cover sheet to be covered thereover. On the other hand, in the case where the light-sensitive element and the image-receiving element are separately formed on two different supports, it is preferred that the processing element is disposed between the light-sensitive element and the image-receiving element at least during the development process. The processing unit preferably contains a light-shielding agent (e.g., carbon black or dyes whose color is changeable in accordance with pH, etc.) and/or a white pigment (e.g., titanium oxide, etc), in accordance with the type of the film unit. Further, in the case of employing a color diffusion transfer system film unit, it is preferable to incorporate a neutralization-timing mechanism comprising a neutralization layer and a neutralization-timing layer into the cover sheet or into the image-receiving element or light-sensitive element.

On the other hand, in the case of employing a heat-development system film unit, a heating element containing electroconductive grains such as fine metallic grains, carbon black or graphite grains can be provided in a pertinent position of the support, light-sensitive element and image-receiving element so that the Joule's heat to be generated under electric current into the heating element can be utilized for heat-development or diffusion transfer of the dye formed. In place of the electroconductive grains can also be used semiconductor inorganic materials (for example, silicon carbide, molybdenum silicide, lanthanum chloride, barium titanate ceramic, tin oxide, zinc oxide, etc.).

The following examples are intended to further illustrate the present invention, but not to limit it in any way.

EXAMPLE 1

Preparation of Emulsion A

An aqueous silver nitrate solution and an aqueous sodium chloride solution containing $0.5\times10^{-4}$ mol of ammonium hexachloro-rhodate(III) were blended in a gelatin solution at 35° C. by a double jet method with controlling the pH value of the reaction system to 6.5, to give a monodispersed silver chloride emulsion having a mean grain size of 0.07 μm.

After the formation of the grains, the soluble salts were removed by the flocculation method which is well known in this technical field, and then 4-hydroxy-6-methyl-1,3,3a,7-tetrazaindene and 1-phenyl-5-mercaptotetrazole were added as a stabilizer. The gelatin content was 55 g and the silver content was 105 g, each in 1 kg of the emulsion. The emulsion thus prepared was designated as Emulsion A.

Formation of Photographic Material

To the above-mentioned Emulsion A were added the nucleating agent, nucleation-accelerating agent and safelight stability-improving dye as mentioned below. Next, polyethyl acrylate latex (14 mg/m$^2$) and further, 2,4-dichloro-6-hydroxy-1,3,5-triazine sodium salt as a hardening agent, were added. The resulting composition was coated on a transparent polyethylene terephthalate support in an amount of 3.5 g/m$^2$ as silver to form a silver halide emulsion layer. Further, a protective layer containing gelatin (1.3 g/m$^2$), the above-mentioned compound No. 2 of the present invention (0.1 g/m$^2$) and the following surfactant, stabilizer and matting agent as were added as coating aids, and then dried. The sample thus prepared was designated as Sample No. 1.

| | Amount added (mg/m$^2$) |
|---|---|
| Nucleating Agent: 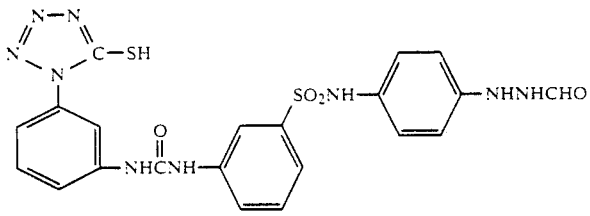 | 11.8 |
| 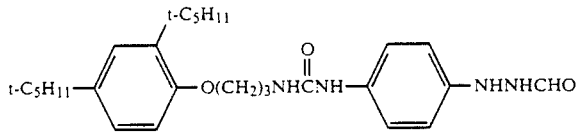 | 9.3 |
| Nucleation-acceleratating Agent: 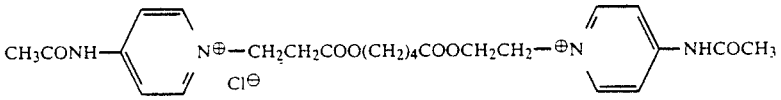 | 28.0 |
| 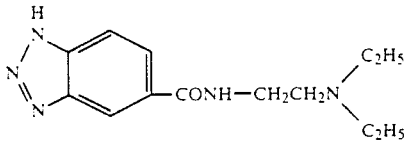 | 60.0 |
| Safe-light Dye: | |

-continued

| | Amount added ($mg/m^2$) |
|---|---|
| 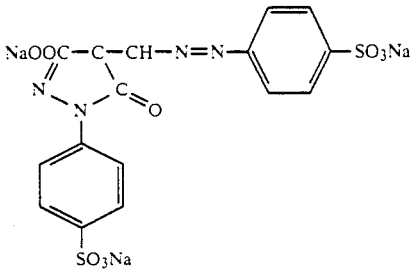 | 50.0 |
| Surfactant: 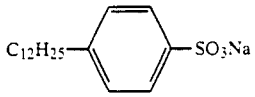 | 37.0 |
| $CH_2COOC_6H_{13}$ \| $CHCOOC_6H_{13}$ \| $SO_3Na$ | 37.0 |
| $C_8F_{17}SO_2N(C_3H_7)CH_2COOK$ | 2.5 |
| Stabilizer: Thiotic Acid | 5.8 |
| Matting Agent: Polymethyl Methacrylate (Mean grain size 2.5μ) | 9.0 |

The compound No. 2 of the present invention was formed into a dispersion as mentioned below, and the dispersion was used in the preparation of the Sample No. 1.

| | |
|---|---|
| Solution (I): | |
| Compound No. 2 | 0.8 g |
| Dimethylformamide | 3.0 ml |
| Citric Acid | 0.05 g |
| $H_2O$ | 22 ml |
| Solution (II): | |
| Gelatin | 2.2 g |
| $H_2O$ | 20 ml |

The solution (II) was stirred at 40° C. and the Solution (I) was gradually added thereto. The pH value of the resulting dispersion was 5.4.

Formation of Comparative Sample (1) Comparative Sample (A) was prepared in the same manner as Sample No. 1 except that the compound No. 2 of the present invention was not added.

(2) Comparative Sample (B) was prepared in the same manner as Sample No. 1 except that the following water-soluble ultraviolet-absorbing dye (0.05 $g/m^2$) was used in place of the compound No. 2.

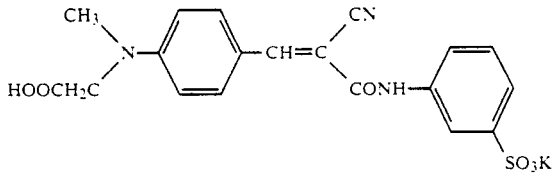

Evaluation of Properties (1) The three Samples set forth above were exposed through an optical wedge with a day-light printer P-607 (by Dainippon Screen Co.), developed with the following developer for 20 seconds at 38° C., and then fixed, rinsed in water and dried in a conventional manner. Both Comparative Sample (B) and Sample No. 1 had a low UV-optical density in the high-light part, like Comparative Sample (A), and this part in these samples was completely discolored. Regarding the sensitivity, Comparative Sample (b) was lower than Comparative Sample (A) by 0.4 as log E, and Sample No. 1 of the invention was lower than Comparative Sample (A) by 0.45 as log E. The sensitivity of Comparative Sample (B) and Sample No. 1 was in a proper range for practical use.

| Base Composition of Developer: | |
|---|---|
| Hydroquinone | 35.0 g |
| N-methyl-p-aminophenol ½-sulfate | 0.8 g |
| Sodium hydroxide | 13.0 g |
| Potassium tertiary phosphate | 74.0 g |
| Potassium sulfite | 90.0 g |
| Tetrasodium ethylenediamine-tetraacetate | 1.0 g |
| Potassium bromide | 4.0 g |
| 5-Methylbenzotriazole | 0.6 g |

-continued

| Base Composition of Developer: | |
|---|---|
| 3-Diethylamino-1,2-propanediol | 15.0 g |
| Water to make | 1 liter (pH = 11.5) |

(2) Test for Safe-light Safety

A safe time for the above-mentioned three samples under a safe light of an UV-cut fluorescent lamp (FLR40SW-SLX-NU/M, by Toshiba Corp.) of 4,000 lux was tested. Regarding the safety, the safe time for Comparative Sample (A) was 10 minutes and that for Comparative Sample (B) was 20 minutes, while that for Sample No. 1 of the present invention was 25 minutes.

From the results of the above described tests (1) and (2), it is noted that compound No. 2 of the present invention can effectively lower the sensitivity to a proper range and further elevate the safe-light safety.

(3) Test for Tone Variability

The above-described three samples were exposed through a plain half-tone screen with the above-mentioned printer and then processed in the same manner as in test (1). The exposure time capable of reversing the dot area to be 1/1, was determined for the respective samples, and then each sample was exposed for a period of time two times or four times longer than the thus determined exposure time, and the degree of the extended dot area was examined.

The larger extension of the dot area means a higher tone variability. The results obtained are shown in Table 1 below. As is apparent from Table 1, Comparative Sample (B) had an extremely poor tone variability, while Sample No. 1 of the present invention had a high tone variability. This is because the dye used in Comparative Sample (B) uniformly diffused into the light-sensitive emulsion layer from the layer initially containing the dye during storage, since the dye was water-soluble and diffusible, and therefore, the extension of the dot area was prevented by the anti-irradiation effect of the said dye even though the exposure time was prolonged. On the other hand, Sample No. 1 of the present invention had a high tone variability, since compound No. 2 of the present invention was firmly fixed in the layer to which the said compound had initially been added.

TABLE 1

| Tone variability (represented by increment of dot area) | | |
|---|---|---|
| | Two Times Longer Exposure | Four Times Longer Exposure |
| Comparative Sample (A) | +5% | +9% |
| Comparative Sample (B) | +2% | +4% |
| Sample No. 1 of the present invention | +5% | +9% |

(4) Evaluation of Stain by Reducer

Strips of Sample No. 1 of the present invention, which had been processed in accordance with the above-noted test No. (3), were dipped in the Farmer's reducer described below for 60 seconds at 20° C., and then rinsed in water and dried. As a result, the 50% dot area was reduced to 33%, and no stain occurred in the thus processed strips.

| Farmer's Reducer: | | |
|---|---|---|
| Solution-1: | Water | 200 ml |
| | Sodium Thiosulfate | 20 g |
| Solution-2: | Water | 100 ml |
| | Red Prussiate | 10 g |

Solution-1, solution-2 and water were blended in a proportion of 100 parts, 5 parts and 100 parts, respectively, just before use.

(5) Measurement of Diffusion Coefficient

In accordance with the means as mentioned above, the diffusion coefficient of compound No. 2 of the present invention and the ultraviolet absorbing dye used in Comparative Sample (B) was measured.

| | Diffusion coefficient ($cm^2$/sec) |
|---|---|
| Compound No. 2 | $7.6 \times 10^{-9}$ |
| Dye in Comparative Sample (B) | $1.9 \times 10^{-6}$ |

Compound No. 2 was suspended in water, and the Krafft point measured in accordance with the method described in M. Hato & K. Shinoda, *J. Phys. Chem.*, vol 77, 378 (1973). As a result, the Krafft point was 92° C.

EXAMPLE 2

Other samples were prepared in the same manner as Example 1, except that compound Nos. 1, 3, 6, 8, 9 or 12 were used in place of compound No. 2.

As a result, the samples obtained had an elevated safe-light safety and an enlarged tone variability, like Sample No. 1 of Example 1. After being dipped in a reducer, no stain formed in the samples. The diffusion coefficients were $1.56\times10^{-8}$, $1.86\times10^{-9}$, $2.7\times10^{-8}$, $4.2\times10^{-9}$, $4.6\times10^{-8}$ and $1.10\times10^{-7}$ $cm^2$/sec, respectively. Regarding the Krafft point, compound No. 1 had a Krafft point of 39° C., and the other compounds had a point falling within the range between 40° C. and 90° C.

EXAMPLE 3

Using compound No. 2, various gelatin dispersions were prepared, and the dispersion stability of the dispersions was compared with each other.

The following Dispersions (A) to (E) were prepared. The Dispersion (A) was standard.

| Dispersion (A) (pH 5.4): | | |
|---|---|---|
| Solution-I: | Compound No. 2 | 0.8 g |
| | Dimethylformamide | 3.0 ml |
| | Citric Acid | 0.05 g |
| | $H_2O$ | 22 ml |
| Solution-II: | Gelatin | 2.2 g |
| | $H_2O$ | 20 ml |

Dispersion (B) (pH 7.0)

Citric acid was omitted from Dispersion (A).

Dispersion (C) (pH 5.4)

Phosphoric acid was used in place of citric acid, and the pH was adjusted to 5.4.

Dispersion (D) (pH 5.2)

Phosphoric acid was used in place of citric acid, and the pH was adjusted to 5.2.

Dispersion (E) (pH 7.5)

Sodium carbonate was used in place of citric acid and the pH was adjusted to 7.5.

The above Dispersions (A) to (E) were stored at 40° C. The Dispersions (B) and (E) formed crystals in one day, while the other Dispersion (A), (C) and (D) formed no crystal even after being stored for 4 days. The results show that the dispersion stability can unexpectedly be extremely improved when the dispersions are adjusted to have a neutral or lower pH.

EXAMPLE 4

Multilayer color photographic material was prepared by forming plural layers, each having the composition shown below, on a cellulose triacetate film support coated with a subbing layer. The sample thus formed was designated as Sample No. 401.

Composition of Photographic Material

The amount coated was represented by the unit of $g/m^2$ as silver for silver halides and colloidal silver, the unit of $g/m^2$ as couplers and other additives, and the unit of molar number per mol of the silver halide in the same layer for sensitizing dyes.

| | |
|---|---|
| First Layer: Anti-halation Layer | |
| Black colloidal silver | 0.2 as Ag |
| Gelatin | 2.2 |
| UV-1 (Ultraviolet absorbent) | 0.1 |
| UV-2 (Ultraviolet absorbent) | 0.2 |
| Cpd-1 | 0.05 |
| Solv-1 (Dispersion oil for UV-1, UV-2) | 0.01 |
| Solv-2 (Dispersion oil for UV-1, UV-2) | 0.01 |
| Solv-3 (Dispersion oil for Cpd-1) | 0.08 |
| Second Layer: Interlayer | |
| Fine silver halide grains (AgBr with mean grain size of 0.07μ) | 0.15 as Ag |
| Gelatin | 1.0 |
| Cpd-2 (Color mixing preventing agent) | 0.2 |
| Third Layer: First Red-sensitive Emulsion Layer (1st RL) | |
| Silver iodobromide emulsion (AgI 10.0 mol %, AgI-rich core type, sphere-corresponding diameter 0.8μ, fluctuation coefficient of sphere-corresponding diameter 28%, tabular grains, aspect ratio of diameter/thickness 3.0) | 0.7 as Ag |
| Silver iodobromide emulsion (AgI 6.0 mol %, AgI-rich core type, sphere-corresponding diameter 0.5μ, fluctuation coefficient of sphere-corresponding diameter 26%, tabular grains, aspect ratio of diameter/thickness 3.0) | 0.5 as Ag |
| Gelatin | 2.0 |
| SD-1 (Sensitizing dye) | $4.5 \times 10^{-4}$ mol |
| SD-2 (Sensitizing dye) | $1.5 \times 10^{-4}$ mol |
| SD-3 (Sensitizing dye) | $0.4 \times 10^{-4}$ mol |
| SD-4 (Sensitizing dye) | $0.3 \times 10^{-4}$ mol |
| EXC-1 (Coupler) | 0.55 |
| EXC-2 (DIR coupler) | 0.01 |
| EXC-3 (Colored coupler) | 0.03 |
| Solv-1 (Dispersion oil EXC-1, 2, 3) | 0.2 |
| Solv-3 (Dispersion oil EXC-1, 2, 3) | 0.2 |
| Fourth Layer: Second Red-sensitive Emulsion Layer (2nd RL) | |
| Silver iodobromide emulsion (AgI 10.0 mol %, AgI-rich core type, sphere-corresponding diameter 1.0μ, fluctuation coefficient of sphere-corresponding diameter 30%, tabular grains, aspect ratio of diameter/thickness 4.3) | 1.0 as Ag |
| Gelatin | 1.3 |
| SD-1 (Sensitizing dye) | $3.0 \times 10^{-4}$ |
| SD-2 (Sensitizing dye) | $1.0 \times 10^{-4}$ |
| SD-3 (Sensitizing dye) | $0.3 \times 10^{-4}$ |
| SD-4 (Sensitizing dye) | $0.3 \times 10^{-4}$ |
| EXC-1 (Coupler) | 0.09 |
| EXC-3 (Colored coupler) | 0.06 |
| EXC-4 (Coupler) | 0.12 |
| Solv-1 (Dispersion oil for EXC-1, 3, 4) | 0.12 |
| Solv-2 (Dispersion oil for EXC-1, 3, 4) | 0.12 |
| Fifth Layer: Interlayer | |
| Gelatin | 1.3 |
| Cpd-4 (Color mixing preventing agent) | 0.2 |
| Sixth Layer: First Green-sensitive Emulsion Layer (1st GL) | |
| Silver iodobromide emulsion (AgI 10.0 mol %, AgI-rich core type, sphere-corresponding diameter 0.8μ, fluctuation coefficient of sphere-corresponding diameter 28%, tabular grains, aspect ratio of diameter/thickness 3.0) | 0.2 as Ag |
| Silver iodobromide emulsion (AgI 6.0 mol %, AgI-rich core type, sphere-corresponding diameter 0.5μ, fluctuation coefficient of sphere-corresponding diameter 26%, tabular grains, aspect ratio of diameter/thickness 3.0) | 1.0 as Ag |
| Gelatin | 1.4 |
| SD-5 (Sensitizing dye) | $5.0 \times 10^{-4}$ |
| SD-6 (Sensitizing dye) | $2.0 \times 10^{-4}$ |
| SD-7 (Sensitizing dye) | $2.0 \times 10^{-4}$ |
| SD-7 (Sensitizing dye) | $1.0 \times 10^{-4}$ |
| EXM-1 (Coupler) | 0.48 |
| EXM-2 (DIR Coupler) | 0.06 |
| EXM-5 (Colored coupler) | 0.06 |
| Solv-1 (Dispersion oil EXM-1, 2, 5) | 0.2 |
| Seventh Layer: Second Green-sensitive Emulsion Layer (2nd GL) | |
| Silver iodobromide emulsion (AgI 10.0 mol %, AgI-rich core type, sphere-corresponding diameter 0.25μ, fluctuation coefficient of sphere-corresponding diameter 28%, tabular grains, aspect ratio of diameter/thickness 3.0) | 0.6 as Ag |
| Gelatin | 0.5 |
| SD-5 (Sensitizing dye) | $3.5 \times 10^{-4}$ |
| SD-6 (Sensitizing dye) | $1.4 \times 10^{-4}$ |
| SD-7 (Sensitizing dye) | $0.7 \times 10^{-4}$ |
| EXM-1 (Coupler) | 0.25 |
| EXM-3 (Colored Coupler) | 0.05 |
| Solv-1 (Dispersion oil for EXM-1, 3) | 0.15 |
| Eighth Layer: Interlayer | |
| Gelatin | 1.0 |
| Ninth Layer: Third Red-sensitive Emulsion Layer (3rd RL) | |
| Silver iodobromide emulsion (mean grain size 1.5μ, AgI 10.0 mol %, AgI-rich core type, sphere-corresponding diameter 1.5μ, fluctuation coefficient of sphere-corresponding diameter 32%, tabular grains, aspect ratio of diameter/thickness 6.0) | 0.8 as Ag |
| Gelatin | 1.2 |
| SD-1 (Sensitizing dye) | $2.0 \times 10^{-4}$ |
| SD-2 (Sensitizing dye) | $0.6 \times 10^{-4}$ |
| SD-3 (Sensitizing dye) | $0.2 \times 10^{-4}$ |
| EXC-4 (Coupler) | 0.08 |
| EXC-5 (Coupler) | 0.07 |
| Sovl-1 (Dispersion oil for EXC-4, 5) | 0.12 |
| Sovl-2 (Dispersion oil for EXC-4, 5) | 0.12 |
| Tenth Layer: Functional Silver Halide Emulsion Layer (FL) | |
| Silver iodobromide emulsion (AgI 10.0 mol %, AgI-rich core | 0.5 as Ag |

-continued

| | |
|---|---|
| type, sphere-corresponding diameter 1.5μ, fluctuation coefficient of sphere-corresponding diameter 28%, tabular grains, aspect ratio of diameter/thickness 1.0) | |
| Gelatin | 0.5 |
| SD-7 (Sensitizing dye) | $6.0 \times 10^{-4}$ |
| EXY-2 | 0.001 |
| Solv-1 (Dispersion oil for EXY-2) | 0.001 |
| Eleventh Layer: Third-Green-sensitive Emulsion Layer (3rd GL) | |
| Silver iodobromide emulsion (AgI 10.0 mol %, AgI-rich core type, sphere-corresponding diameter 1.5μ, fluctuation coefficient of sphere-corresponding diameter 32%, tabular grains, aspect ratio of diameter/thickness 6.0) | 1.5 as Ag |
| Gelatin | 1.4 |
| SD-5 (Sensitizing dye) | $2.0 \times 10^{-4}$ |
| SD-6 (Sensitizing dye) | $0.8 \times 10^{-4}$ |
| SD-7 (Sensitizing dye) | $0.8 \times 10^{-4}$ |
| EXM-4 (Coupler) | 0.15 |
| EXM-1 (Colored coupler) | 0.03 |
| EXC-4 | 0.005 |
| Solv-1 (Dispersion oil for EXC-4, 1, EXC-4) | 0.2 |
| Twelfth Layer: Yellow Filter Layer (YF) | |
| Cpd-3 (Dye) | 0.05 |
| Solv-1 (Dispersion oil for Cpd-3) | 0.05 |
| Gelatin | 0.5 |
| Thirteenth Layer: Interlayer | |
| Gelatin | 0.5 |
| Cpd-2 | 0.1 |
| Solv-1 (Dispersion oil for Cpd-2) | 0.1 |
| Fourteenth Layer: First Blue-sensitive Emulsion Layer (1st BL) | |
| Silver iodobromide emulsion (AgI 8.2 mol %, I-rich core type, sphere-corresponding diameter 0.7μ, fluctuation coefficient of sphere-corresponding diameter 21%, octahedral grains) | 0.2 as Ag |
| Silver iodobromide emulsion (AgI 3.0 mol %, I-rich core type, sphere-corresponding diameter 0.3μ, fluctuation coefficient of sphere-corresponding diameter 22%, octahedral grains) | 0.1 as Ag |
| Gelatin | 1.2 |
| SD-8 (Sensitizing dye) | $3.0 \times 10^{-4}$ |
| EXY-1 (Coupler) | 0.7 |

-continued

| | |
|---|---|
| EXY-2 (DIR Coupler) | 0.03 |
| Solv-1 (Dispersion oil for EXY-1, 2) | 0.5 |
| Fifteenth Layer: Second Blue-sensitive Emulsion Layer (2nd BL) | |
| Silver iodobromide emulsion (AgI 10.0 mol %, AgI-rich core type, sphere-corresponding diameter 1.0μ, fluctuation coefficient of sphere-corresponding diameter 30%, tabular grains, aspect ratio of diameter/thickness 4.0) | 0.4 as Ag |
| Gelatin | 0.3 |
| SD-8 (Sensitizing dye) | $2.0 \times 10^{-4}$ |
| EXY-1 (Coupler) | 0.3 |
| Solv-1 (Dispersion oil for EXY-1) | 0.2 |
| Sixteenth Layer: Interlayer | |
| Fine silver iodobromide grains (AgI 2 mol %, uniform type, sphere-corresponding diameter 0.13μ) | 0.4 as Ag |
| Gelatin | 0.4 |
| Seventeenth Layer: Third Blue-sensitive Emulsion Layer (3rd BL) | |
| Silver iodobromide emulsion (AgI 14.0 mol %, AgI-rich core type, sphere-corresponding diameter 2.1μ, fluctuation coefficient of sphere-corresponding diameter 30%, tabular grains, aspect ratio of diameter/thickness 5.0) | 1.4 as Ag |
| Gelatin | 1.1 |
| SD-8 (Sensitizing dye) | $1.5 \times 10^{-4}$ |
| EXY-1 (Coupler) | 0.2 |
| Solv-1 (Dispersion oil for EXY-1) | 0.14 |
| Eighteenth Layer: First Protective Layer | |
| Gelatin | 1.8 |
| UV-1 (Ultraviolet absorbent) | 0.1 |
| UV-2 (Ultraviolet absorbent) | 0.2 |
| Solv-1 (Dispersion oil for UV-1, 2) | 0.01 |
| Solv-2 (Dispersion oil for UV-1, 2) | 0.01 |
| Nineteenth Layer: Second Protective Layer | |
| Fine silver halide grains (AgBr with mean grain size of 0.07μ) | 0.3 as Ag |
| Gelatin | 0.7 |
| Polymethyl methacrylate grains (diameter 1.5μ) | 0.2 |
| W-1 (Static charge adjusting agent) | 0.02 |
| H-1 (hardening agent) | 0.4 |
| Cpd-5 (Formaldehyde scavenger) | 1.0 |

The compounds used, and set forth above had the following structural formulae.

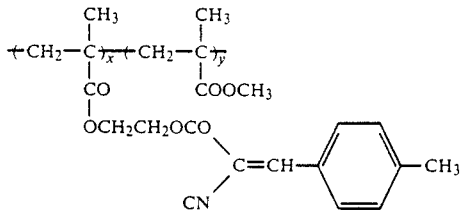

UV-1 x/y = 7/3 (weight ratio)

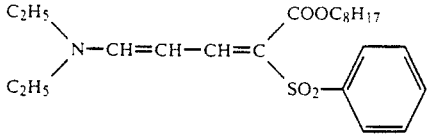

UV-2

-continued
EXM-3
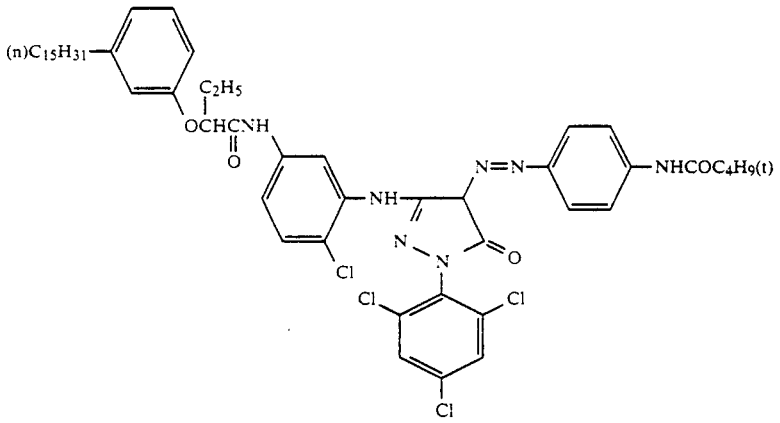
EXC-3
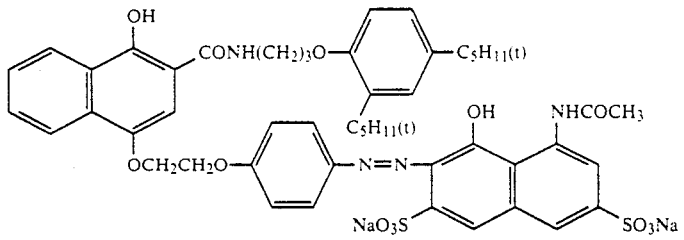
EXC-1
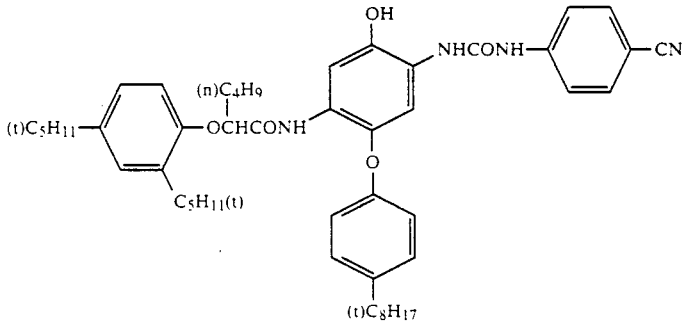
EXC-2
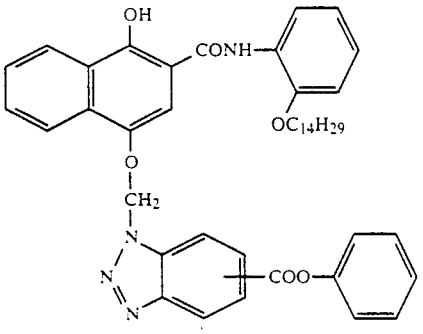
EXC-4
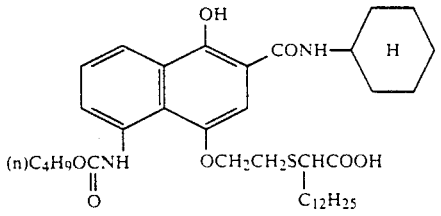

-continued
EXC-5
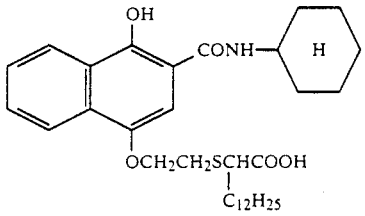
EXM-1
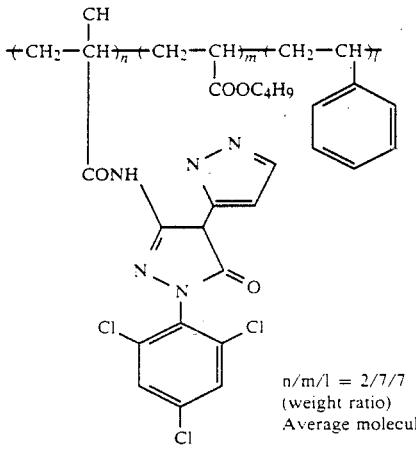
n/m/l = 2/7/7
(weight ratio)
Average molecular weight: 40,000
EXM-2
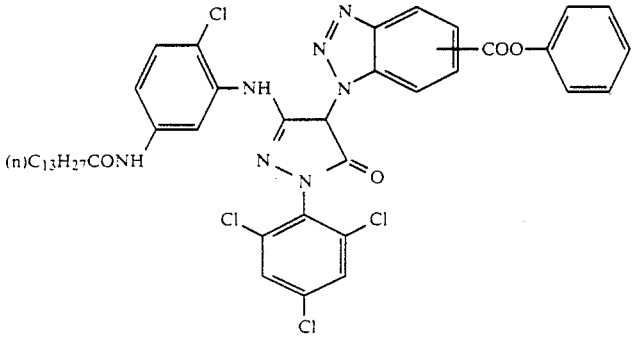
EXM-4
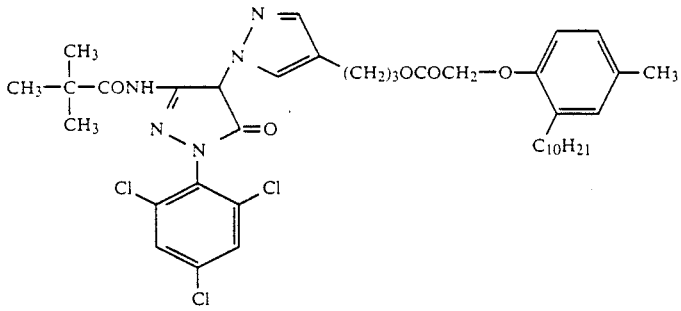
EXM-5
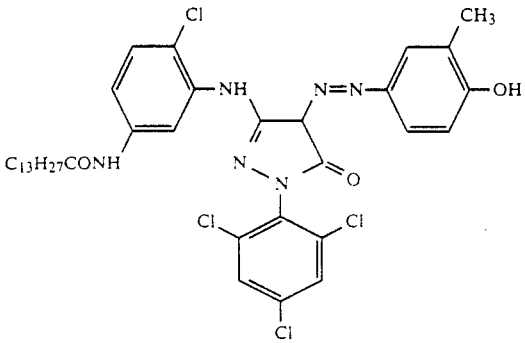

-continued
EXM-6
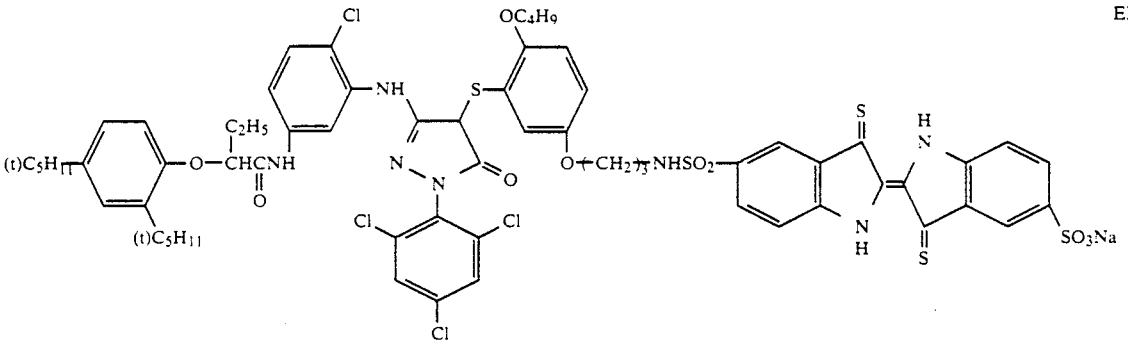
EXY-1
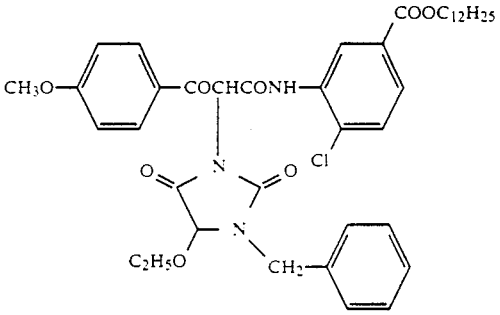
EXY-2
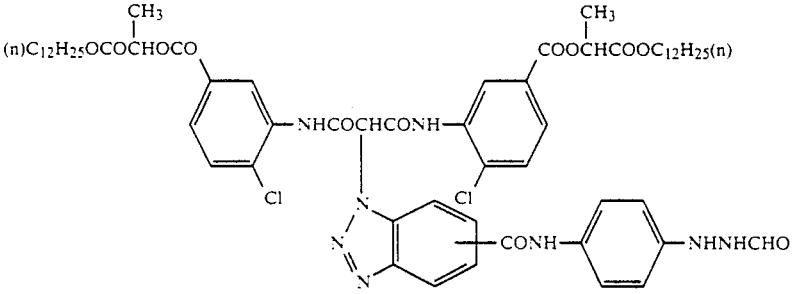
SD-1
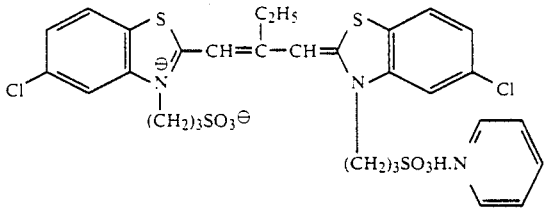
SD-2
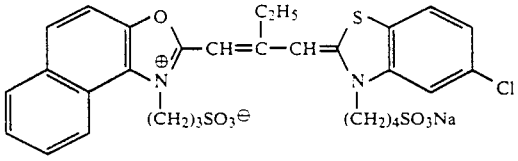
SD-3
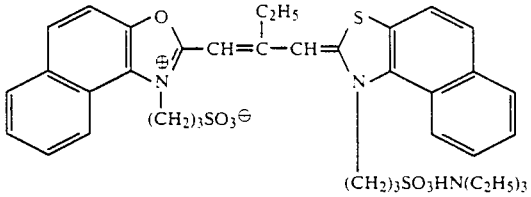

-continued
SD-4
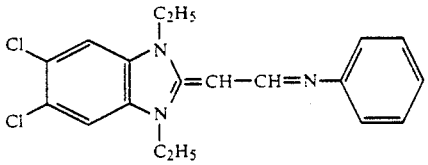
SD-5
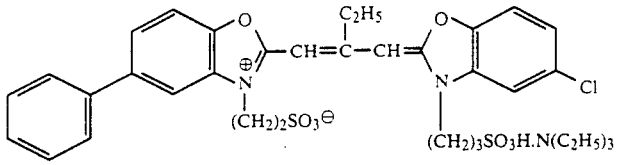
SD-6
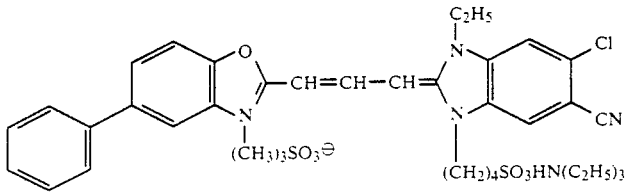
SD-7
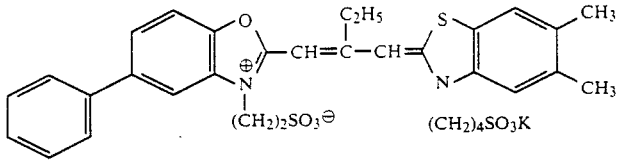
SD-8
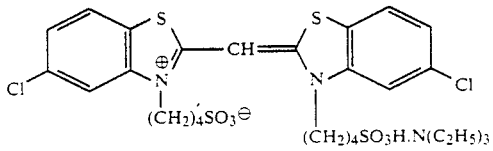
Solv-1
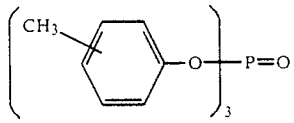
Solv-2
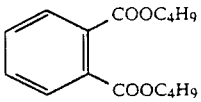
Solv-3
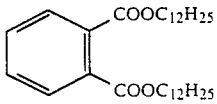
Solv-4
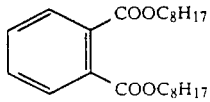
Cpd-1
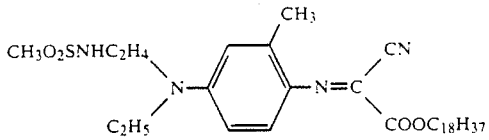

-continued

Cpd-2

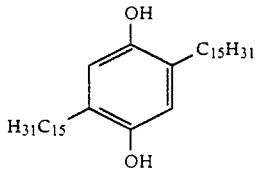

Cpd-3

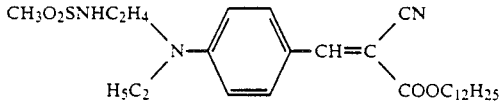

Cpd-4

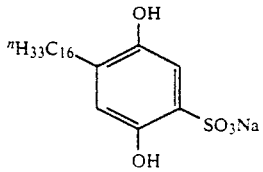

Cpd-5

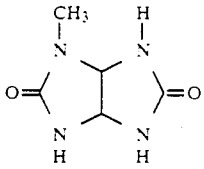

W-1

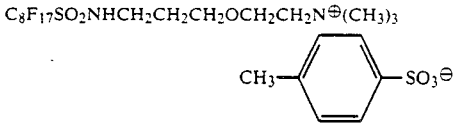

H-1

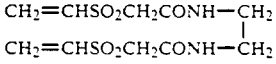

Compound (X)

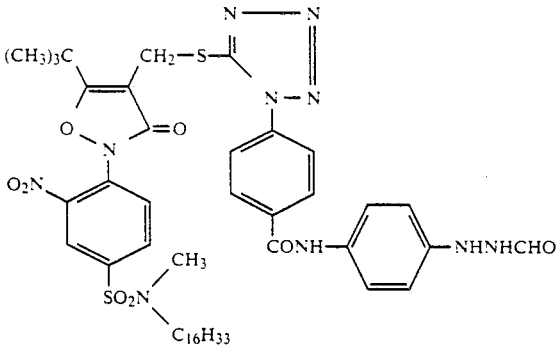

In the preparation of Sample No. 401, the solvents (e.g., Solv-1, etc.) were used for dispersing by a conventional oil-protect dispersion method.

Samples Nos. 402 and 403 were prepared in the same manner as Sample No. 401, except that the compositions of the tenth layer and the twelfth layer were varied as shown in Table 2 below and the thirteenth layer was omitted.

TABLE 2

| | Sample No. 402 | | Sample No. 403 | |
|---|---|---|---|---|
| 10th Layer | Same as Sample No. 401 | | EXM-6 | 0.02 |
| | | | Compound (X) | 0.005 |
| | | | Solv-1 | 0.01 |
| | | | Reducing Agent S-69 | 0.005 |
| | | | were used, in place of EXY-2 and Solv-1, and the others were same as No. 401 | |
| 12th Layer | This comprised the following: | | Same as the 12th layer of Sample No. 402. | |
| | Compound No. 6 | 0.01 | This was formed by Dispersion method (B) | |
| | Reducing Agent S-67 | 0.5 | Mentioned below. | |
| | Gelatin | 0.75 | | |
| | The ingredients were dispersed | | | |

TABLE 2-continued

| Sample No. 402 | Sample No. 403 |
|---|---|
| by Dispersion Method (A) mentioned below. | |

Dispersion Method (A):

4 g of the compound No. 6 was dissolved in 16 ml of methyl ethyl ketone, and 100 ml of water was added thereto and then 0.2 g of citric acid was added to obtain a dispersant-containing solution. This was added to 200 ml of an aqueous 10% gelatin solution with strong stirring with a homogenizer, to obtain a dispersion.

On the other hand, 10 g of the Reducing Agent S-67 was dissolved in 50 ml of methanol and 300 ml of water was added thereto. This was added to 500 ml of an aqueous 10% gelatin solution by the aid of Surfactant (W-3) with strong stirring with a homogenizer to obtain a dispersion.

The compound No. 6-containing dispersion and the reducing agent-containing dispersion were blended in a determined proportion of the reducing agent to the compound No. 6, to obtain a dispersion mixture containing the compound No. 6 and the Reducing Agent S-67.

Dispersion Method (B): Simultaneous Dispersion of Compound No. 6 and Reducing Agent (S-67)

1 g of the compound No. 6 and 5 g of Reducing Agent (S-67) were dissolved in 30 ml of methyl ethyl ketone, and 200 ml of water was added thereto and then 0.5 g of citric acid was further added thereto to obtain a dispersant composition. This was added to 150 ml of an aqueous 10% gelatin solution by the aid of Surfactant (W-1) with strong stirring with a homogenizer to obtain a dispersion.

The dispersion obtained by Method (A) or (B) was coated on a cellulose triacetate film support and dried, and the film transparency and surface appearance of the sample thus formed was examined. No fault by dispersion insufficiency was found.

Sample Nos. 401, 402 and 403 were cut into picture-taking 35 mm size strips. A color Rendition Chart (by Macbeth) was photographed with the resulting sample strips under a light source having a color temperature of 5500° K. The thus exposed sample strips were thereafter color-developed in accordance with the process as mentioned below, to obtain negative films of the respective sample strips.

These were then printed on Fuji Color Papers (High Tech-Papers) to obtain color photographs.

| Step | Time | Temperature | Tank Capacity |
|---|---|---|---|
| Color Development | 3 min 15 sec | 38° C. | 18 liters |
| Bleaching | 6 min 30 sec | 38° C. | 36 liters |
| Fixation | 3 min 15 sec | 38° C. | 18 liters |
| Rinsing (1) | 1 min 30 sec | 38° C. | 9 liters |
| Rinsing (2) | 1 min 30 sec | 38° C. | 9 liters |
| Stabilization | 40 sec | 38° C. | 9 liters |

The processing solutions used in the above steps were as follows:

| | |
|---|---|
| Color Developer: | |
| Diethylenetriamine-pentaacetic acid | 1.0 |

-continued

| | |
|---|---|
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.3 mg |
| Hydroxyamine | 2.4 |
| 4-(N-ethyl-N-β-hydroxyethylamino)-2-methylaniline sulfate | 4.5 |
| Water to make | 1 liter |
| (Potassium hydroxide to make | pH of 10.7) |
| Bleaching Solution: | |
| Ammonium ethylenediamine-tetraacetic acid ferric complex | 100 g |
| Disodium ethylenediamine-tetraacetic acid | 10.0 g |
| Aqueous ammonia | 7 ml |
| Ammonium nitrate | 10.0 g |
| Ammonium bromide | 150 g |
| Water to make | 1 liter |
| pH | 6.0 |
| Fixing Solution: | |
| Disodium ethylenediamine-tetraacetic acid | 1.0 g |
| Sodium sulfite | 4.0 g |
| Sodium Bisulfite | 4.6 g |
| Aqueous ammonium thiosulfate solution (70%) | 175 ml |
| Water to make | 1 liter |
| pH | 6.6 |
| Rinsing Solution: | |
| City Water (containing 27 mg/liter of calcium and 10 mg/liter of magnesium) | |
| Stabilizer Solution: | |
| Formalin (37% w/v) | 2 ml |
| Polyoxyethylene-p-monononylphenyl ether (mean polymerization degree 10) | 0.3 g |
| Water to make | 1 liter |

As a result of the sensitomery test, Sample Nos. 401, 402 and 403 were almost equivalent in the sensitivity gradation.

In both Sample Nos. 402 and 403, no fault by dispersion insufficiency of the functional compound used was found. In Sample No. 403, the color separation between red and cyan was satisfactory, and the red was sharp and the faithfulness of the color reproduction of the violet color was improved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least two hydrophilic layers, wherein at least one of said hydrophilic layers comprises water or a hydrophilic colloid and a compound represented by formula (II) dispersed therein using a solvent consisting essentially of water or a water-soluble organic solvent in an acidic pH range in such a manner that said compound is resistant to interlayer diffusion:

II

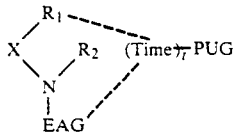

wherein (Time)$_t$-PUG is bonded to at least one of $R_1$, $R_2$, or EAG;

dotted lines indicate at least one chemical bond;

Time represents a group capable of releasing the PUG residual group as triggered by the cleavage of the single bond between the nitrogen atom and X, by the successive reaction;

t represents 0 to 1;

PUG represents a photographically useful group;

X represents an oxygen atom —O—, a sulfur atom —S— or a nitrogen containing group —N($R_3$)—;

$R_1$, $R_2$, and $R_3$ each represents a group except a hydrogen atom, or each may be a chemical bond;

EAG represents a group capable of accepting an electron from a reducing substance that is bonded to the nitrogen atom; and at least one water-soluble group exists in one molecule of said compound, where a single bond between the nitrogen atom and X is cleaved when EAG accepts an electron.

2. A silver halide photographic material as in claim 1, wherein said compound represented by formula (II) contains a sulfonic acid group or a salt thereof, a carboxyl group or a salt thereof, a sulfuric acid group or a salt thereof, a phosphoric acid group or a salt thereof, a hydroxyl group, a sulfamide group, or a formamide group as said water-soluble group.

3. A silver halide photographic material as in claim 2, wherein said compound represented by formula (II) contains a sulfonic acid group or a salt thereof as said water-soluble group.

4. A silver halide photographic material as in claim 1, wherein said compound represented by formula (II) provides a Krafft point of 110° C. or lower, singly or in a mixture of two or more thereof, and in the form of an aqueous solution.

5. A silver halide photographic material as in claim 1, wherein said compound represented by formula (II) has a diffusion constant of about $1\times10^{-6}$ cm$^2$/sec or less in a gelatin gel.

6. A silver halide photographic material as in claim 1, wherein said compound represented by formula (II) is dispersed in a hydrophilic colloid under the condition of a neutral or lower pH value and incorporated into said hydrophilic colloid layer.

7. A silver halide photographic material as in claim 1, wherein said compound represented by formula (II) further contains an aliphatic group having from 4 to 18 carbon atoms as a ballast group.

8. A silver halide photographic material as in claim 1, wherein said compound represented by formula (II) is a compound represented by formula (III):

(III)

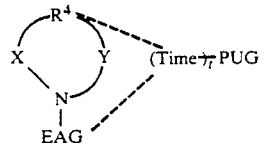

wherein the moiety

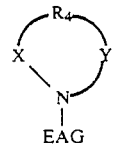

corresponds to PWR in formula (I);

(Time)$_t$-PUG is bonded at least one of $R_4$ and EAG;

dotted lines means that at least one of them represents a chemical bond;

Y represents a divalent linking group;

$R_4$ is bonded to X and Y and represents an atomic group for forming a 5-membered to 8-membered mono- or condensed-heterocyclic ring together with the nitrogen atom in formula (III);

X and EAG have the same meaning as in claim 1.

9. A silver halide photographic material as in claim 1, wherein PUG is a diffusible dye, and contained in an amount of from 0.05 to 50 mmol/m$^2$.

10. A silver halide photographic material as in claim 1, wherein PUG is a development inhibitor, a development accelerator, or a nucleating agent, and contained in an amount of from $1\times10^{-7}$ to $1\times10^{-1}$ mole per mole of silver halide.

11. A silver halide photographic material as in claim 1, wherein PUG is a silver halide solvent, and contained in an amount of from $1\times10^{-5}$ to $1\times10^{3}$ mole per mole of silver halide.

12. A silver halide photographic material as in claim 1, further comprising a reducing substance having an oxidation potential of 0.80 volts or less.

13. A silver halide photographic material as in claim 1, further comprising an anionic or nonionic surfactant.

14. A silver halide photographic material as in claim 1, further comprising at least one color image forming coupler.

15. A silver halide photographic material as in claim 7, wherein said compound represented by formula (II) further contains a sulfamoyl or carbamoyl group substituted with an aliphatic group, as a ballast group.

* * * * *